US012800214B2

(12) United States Patent
Mitchell

(10) Patent No.: US 12,800,214 B2
(45) Date of Patent: Nov. 17, 2026

(54) APPLIANCE ICE MAKING ASSEMBLY

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 237 days.

(21) Appl. No.: 18/598,165

(22) Filed: Mar. 7, 2024

(65) Prior Publication Data

US 2025/0283647 A1 Sep. 11, 2025

(51) Int. Cl.
*F25C 5/06* (2006.01)
*F25C 1/243* (2018.01)

(52) U.S. Cl.
CPC ..... *F25C 5/06* (2013.01); *F25C 1/243* (2013.01); *F25C 2305/0221* (2021.08)

(58) Field of Classification Search
CPC .... F25C 1/04; F25C 1/243; F25C 2305/0221; F25C 5/06; F25C 5/22
See application file for complete search history.

(56) References Cited

U.S. PATENT DOCUMENTS 5,261,248 A * 11/1993 Willis ..... F25C 1/04 62/353
9,234,689 B2 * 1/2016 Son ..... F25C 1/10
9,335,081 B2 * 5/2016 Son ..... F25C 1/04
10,788,252 B2 9/2020 Mitchell et al.
11,181,310 B2 * 11/2021 Harata ..... F25C 1/25
11,231,217 B2 * 1/2022 Mitchell ..... F25C 1/25
11,428,451 B2 * 8/2022 Kim ..... F25C 1/04
11,486,623 B2 11/2022 Mitchell
11,543,166 B2 1/2023 Trejo et al.
11,543,167 B2 1/2023 Mitchell
11,709,008 B2 * 7/2023 Naik ..... F25C 5/08 62/136
11,747,071 B2 9/2023 Kyriacou
12,228,323 B2 * 2/2025 Kim ..... F25C 1/04
12,259,171 B2 * 3/2025 Mitchell ..... F25C 1/04
2013/0160480 A1 6/2013 Athanasiou et al.
2015/0241102 A1 * 8/2015 Lee ..... F25D 23/04 62/344

(Continued)

FOREIGN PATENT DOCUMENTS

EP 3653967 B1 6/2022
JP 2000258007 A 9/2000

OTHER PUBLICATIONS

Kyriacou et al., U.S. Appl. No. 18/160,715, filed Jan. 27, 2023, 24 pages.

(Continued)

*Primary Examiner* — Filip Zec
(74) *Attorney, Agent, or Firm* — Dority & Manning, P.A.

(57) ABSTRACT

An ice making assembly includes a mold defining a cavity for formation of an ice piece. An ejector may be positioned adjacent to the mold. The mold and the ejector may be rotated between a first position and a second position. The ejector may push the ice piece out of the cavity during rotation between the first position and the second position. The mold and the ejector may be components of a cartridge. The mold and the ejector may be releasably received in a rotatable carriage.

16 Claims, 27 Drawing Sheets

(56) References Cited

U.S. PATENT DOCUMENTS

| | | | | |
|---|---|---|---|---|
| 2019/0170420 | A1* | 6/2019 | Besore | F25C 1/04 |
| 2020/0080759 | A1* | 3/2020 | Shi | F25C 5/22 |
| 2021/0318051 | A1 | 10/2021 | Mitchell | |
| 2021/0325100 | A1* | 10/2021 | Smith | F25C 1/04 |
| 2022/0316782 | A1* | 10/2022 | Mitchell | F25C 5/06 |
| 2022/0341644 | A1* | 10/2022 | Baumer | F25C 5/187 |
| 2022/0357088 | A1* | 11/2022 | Kim | F25C 5/187 |
| 2023/0213257 | A1 | 7/2023 | Mitchell et al. | |
| 2023/0221053 | A1 | 7/2023 | Mitchell | |
| 2024/0110739 | A1* | 4/2024 | Mitchell | F25C 1/04 |

OTHER PUBLICATIONS

Junge et al., U.S. Appl. No. 18/163,586, filed Feb. 2, 2023, 48 pages.
Nuss et al., U.S. Appl. No. 18/163,554, filed Feb. 2, 2023, 47 pages.
Vijayan et al., U.S. Appl. No. 18/318,250, filed May 16, 2023, 34 pages.
Mitchell, U.S. Appl. No. 18/474,788, filed Sep. 26, 2023, 25 pages.

* cited by examiner

APPLIANCE ICE MAKING ASSEMBLY

FIELD

The subject matter of the present disclosure relates generally to an appliance for making ice.

BACKGROUND

Ice makers are commonly provided as stand-alone appliances or may be incorporated within larger refrigerated appliances used to store food items in both commercial and residential applications. Typically, such ice makers are configured for the bulk production of ice where e.g., multiple pieces of ice are used to cool the same beverage or used to cool other food items.

Some consumers may prefer a particular size or shape of ice for certain beverages and may prefer another size or shape for other beverages. Typical ice makers, however, are large, inefficient, experience a variety of performance related issues, and only produce one shape or size of ice cube. For example, conventional twist tray icemakers include a partitioned plastic mold that is physically deformed to break the bond formed between ice and the tray. However, these icemakers require additional room to fully rotate and twist the tray. In addition, the ice cubes are frequently fractured during the twisting process. When this occurs, a portion of the cubes may remain in the tray, thus resulting in overfilling during the next fill process. Further, conventional ice making assemblies only offer one style of ice cube.

Certain conventional icemakers include a harvest heater that helps to release ice cubes from the mold, but such heaters are typically placed far from the water discharge spout where ice buildup may occur. As a result, these harvest heaters must be turned on for a long period of time in order to melt the entire cube and the clogged water spout, thus increasing energy consumption and adding significant time to the cube formation process.

Accordingly, an ice maker with improved versatility would be desirable. More particularly, an ice making assembly that is compact, efficient, reliable, and capable of forming more than one type of ice cube would be particularly beneficial.

BRIEF DESCRIPTION

Aspects and advantages of the invention will be set forth in part in the following description, or may be apparent from the description, or may be learned through practice of the invention.

In one exemplary embodiment, an ice making assembly for an ice maker appliance is provided. The assembly includes a carriage. The carriage is rotatable between a first position and a second position. The assembly also includes a mold defining a cavity for formation of an ice piece. The mold is releasably received in the carriage whereby the mold is rotatable with the carriage between the first position and the second position. An ejector is positioned adjacent to the mold and is rotatable with the carriage between the first position and the second position. The ejector is configured to push the ice piece out of the cavity as the carriage rotates between the first position and the second position. A motor provides for rotating the carriage from the first position to the second position.

In another exemplary embodiment, an ice making assembly for an ice maker appliance is provided. The assembly includes a cartridge. The cartridge includes a mold and an ejector. The mold defines a cavity for formation of an ice piece therein. The ejector is positioned adjacent to the mold. The cartridge is rotatable between a first position and a second position. The ejector is configured to push the ice piece out of the cavity as the cartridge rotates between the first position and the second position.

In yet another exemplary embodiment, a cartridge for an ice making assembly is provided. The cartridge includes a mold and an ejector. The mold defines a cavity for formation of an ice piece therein. The ejector is positioned adjacent to the mold. The cartridge is rotatable between a first position and a second position. The ejector is configured to push the ice piece out of the cavity as the cartridge rotates between the first position and the second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

The use of the same similar reference numbers in the figures denotes the same or similar features unless the context indicates otherwise.

DETAILED DESCRIPTION

Figure 1:
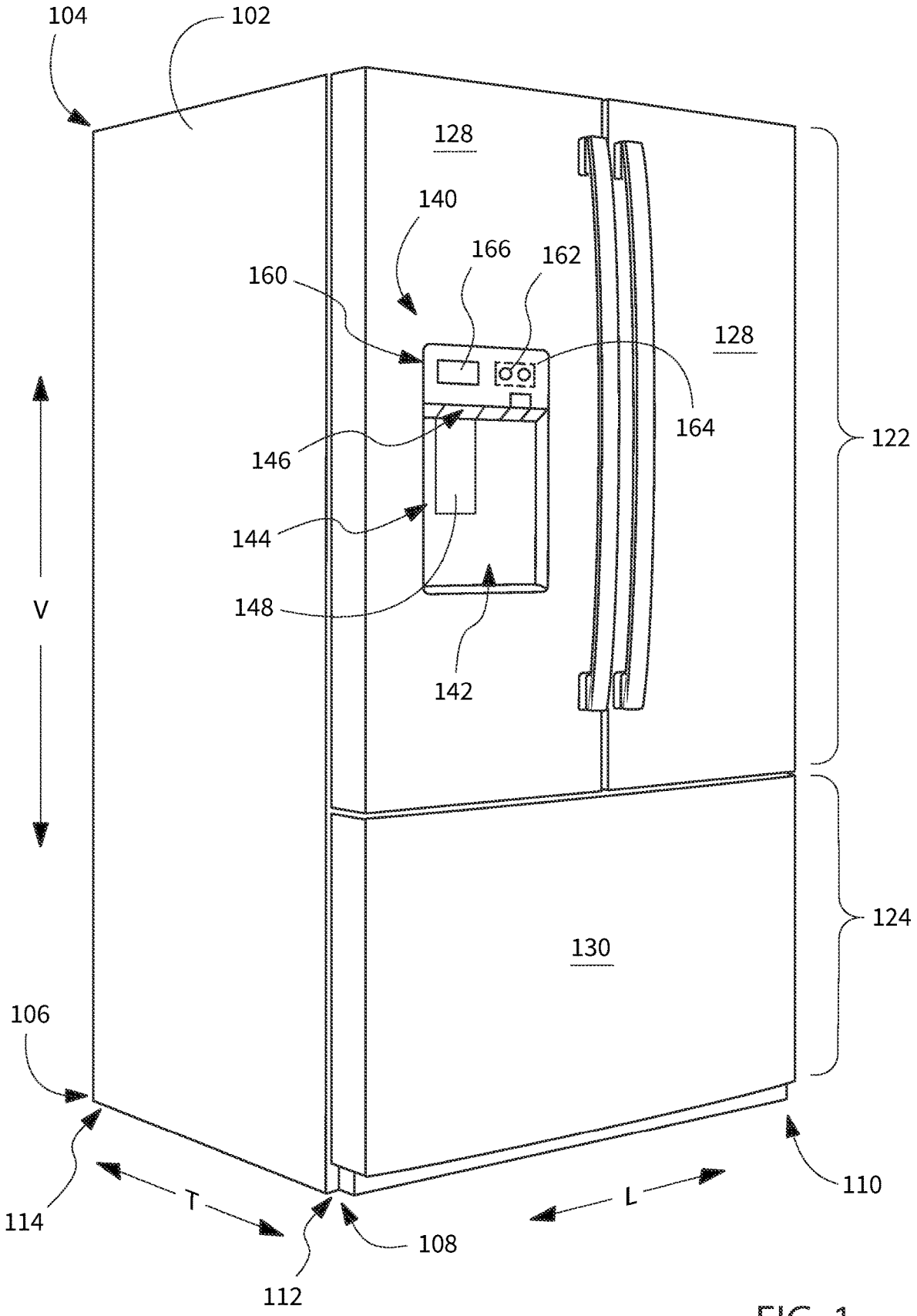
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component from another and are not intended to signify location or importance of the individual components.

Furthermore, the skilled artisan will recognize the interchangeability of various features from different embodiments. Similarly, the various method steps and features described, as well as other known equivalents for each such methods and features, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
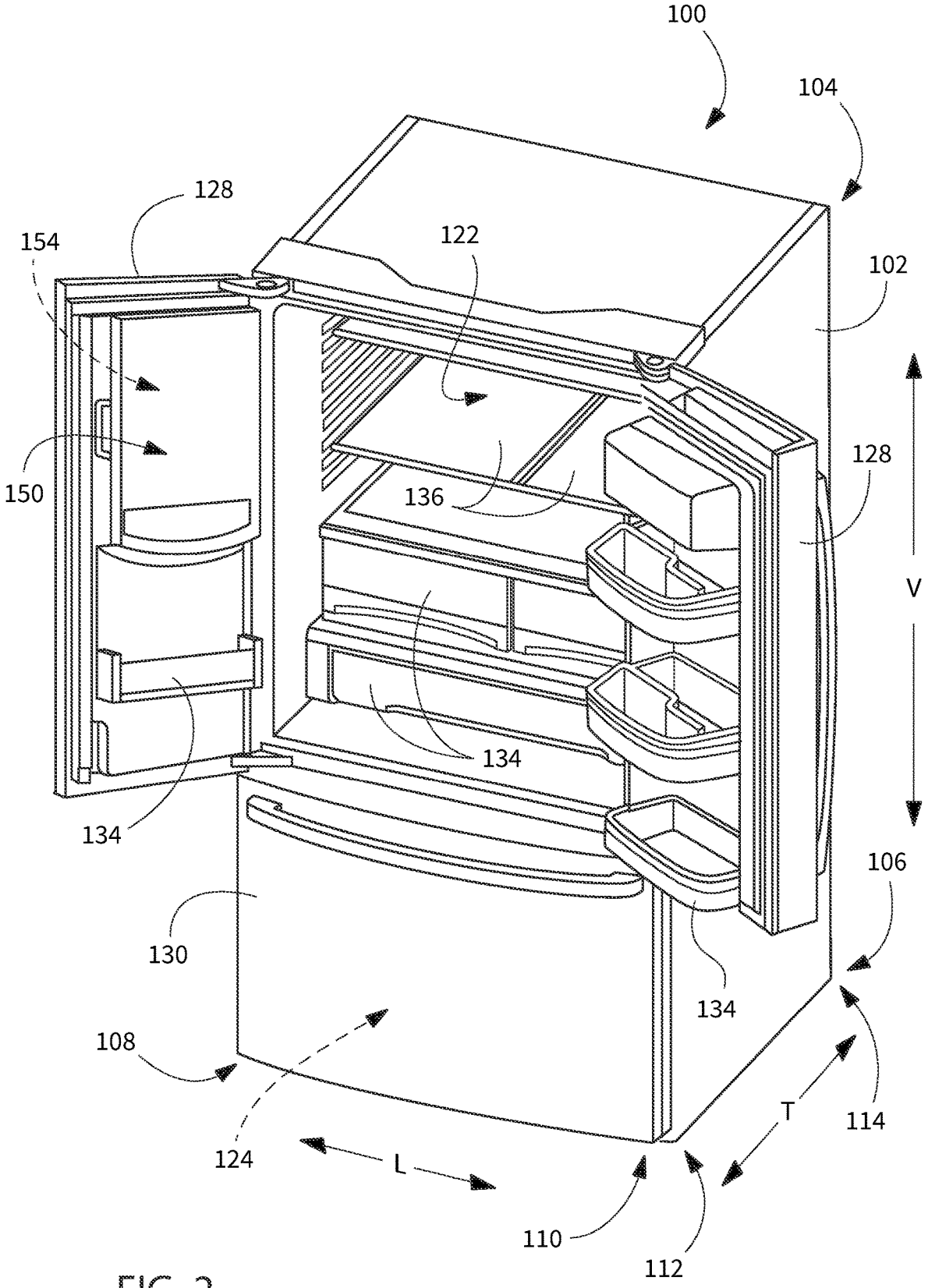
FIG. 2 provides a perspective view of the exemplary refrigerator appliance of FIG. 1, with the doors of the fresh food chamber shown in an open position.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 may include a sensor (such as an ultrasonic sensor) or a button rather than the paddle. Discharging outlet 146 and actuating mechanism 148 are an external part of ice dispenser 144 and are mounted in dispenser recess 142.

By contrast, inside refrigerator appliance 100, refrigerator door 128 may define an icebox 150 (FIGS. 2 through 4) housing an ice making assembly which includes an ice making assembly 200 and an ice storage bin (not shown, but which is understood to be positioned below the ice making assembly 200 for receiving ice pieces harvested from the ice maker, e.g., where the ice pieces fall by gravity from the ice making assembly 200 into the storage bin as a result of the harvest operation of the ice making assembly 200) that are configured to supply ice to dispenser recess 142. In this regard, for example, icebox 150 may define an ice making chamber 154 for housing an ice making assembly and a dispensing mechanism.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations. For example, the instructions may include a software package configured to operate the system to, e.g., execute the exemplary methods described below. In exemplary embodiments, the various method steps as disclosed herein may be performed, e.g., in whole or part, by controller 164 and/or another, separate, dedicated controller.

Figure 3:
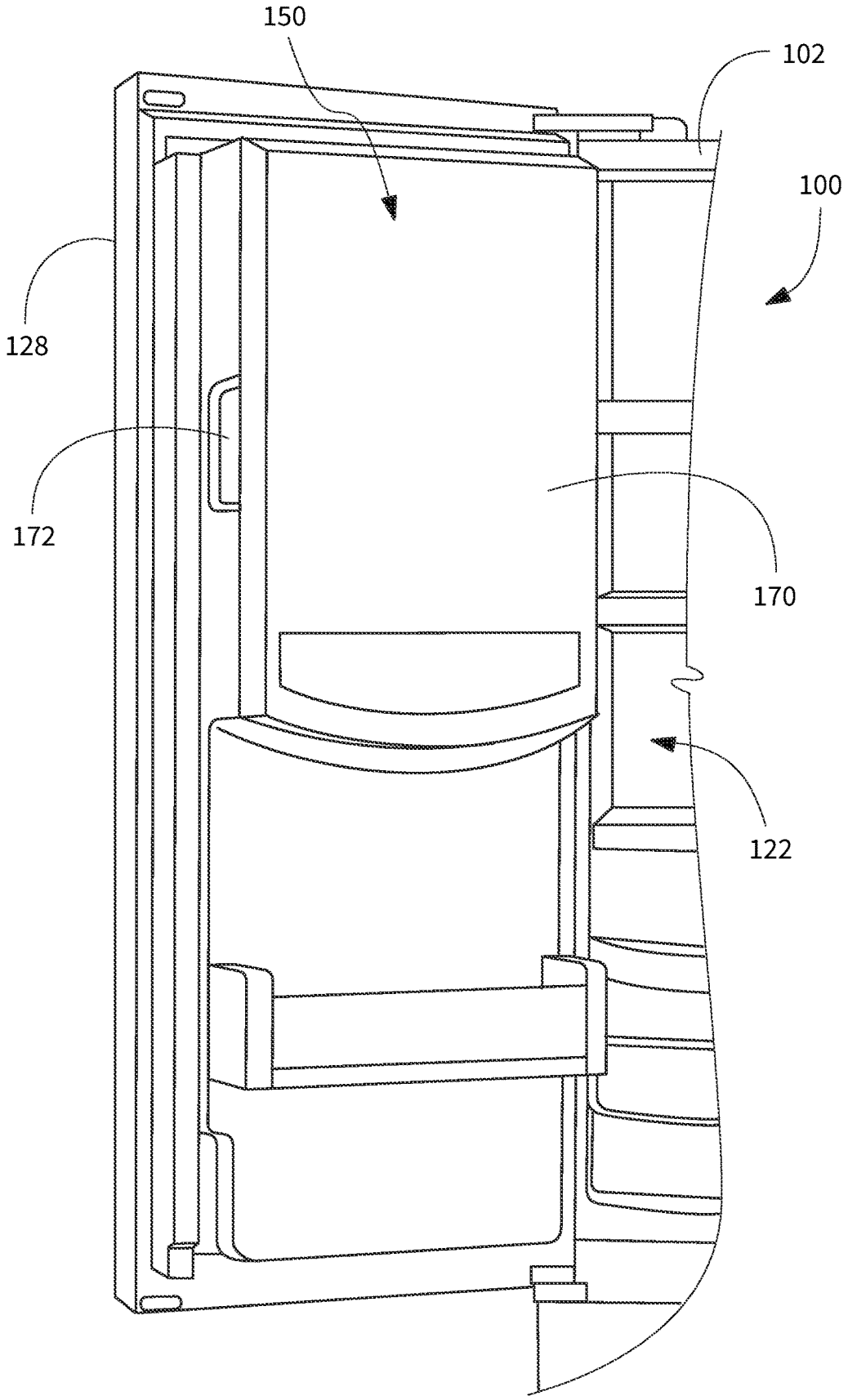
FIG. 3 provides an interior perspective view of a dispenser door of the exemplary refrigerator appliance of FIG. 1.
Figure 4:
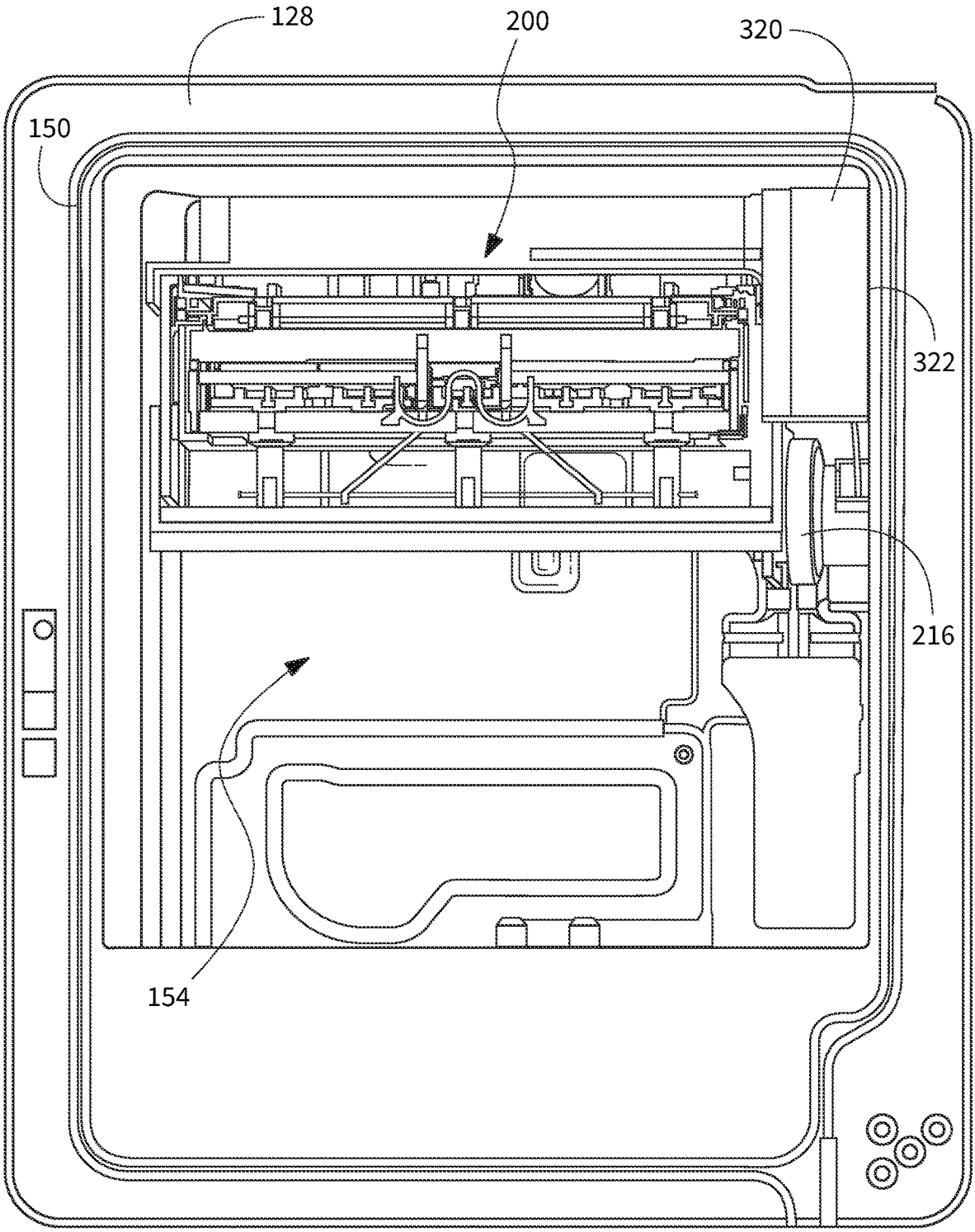
FIG. 4 provides an interior elevation view of the door of FIG. 3 with an access door of the door removes to reveal an ice making assembly therebehind.
Figure 5:
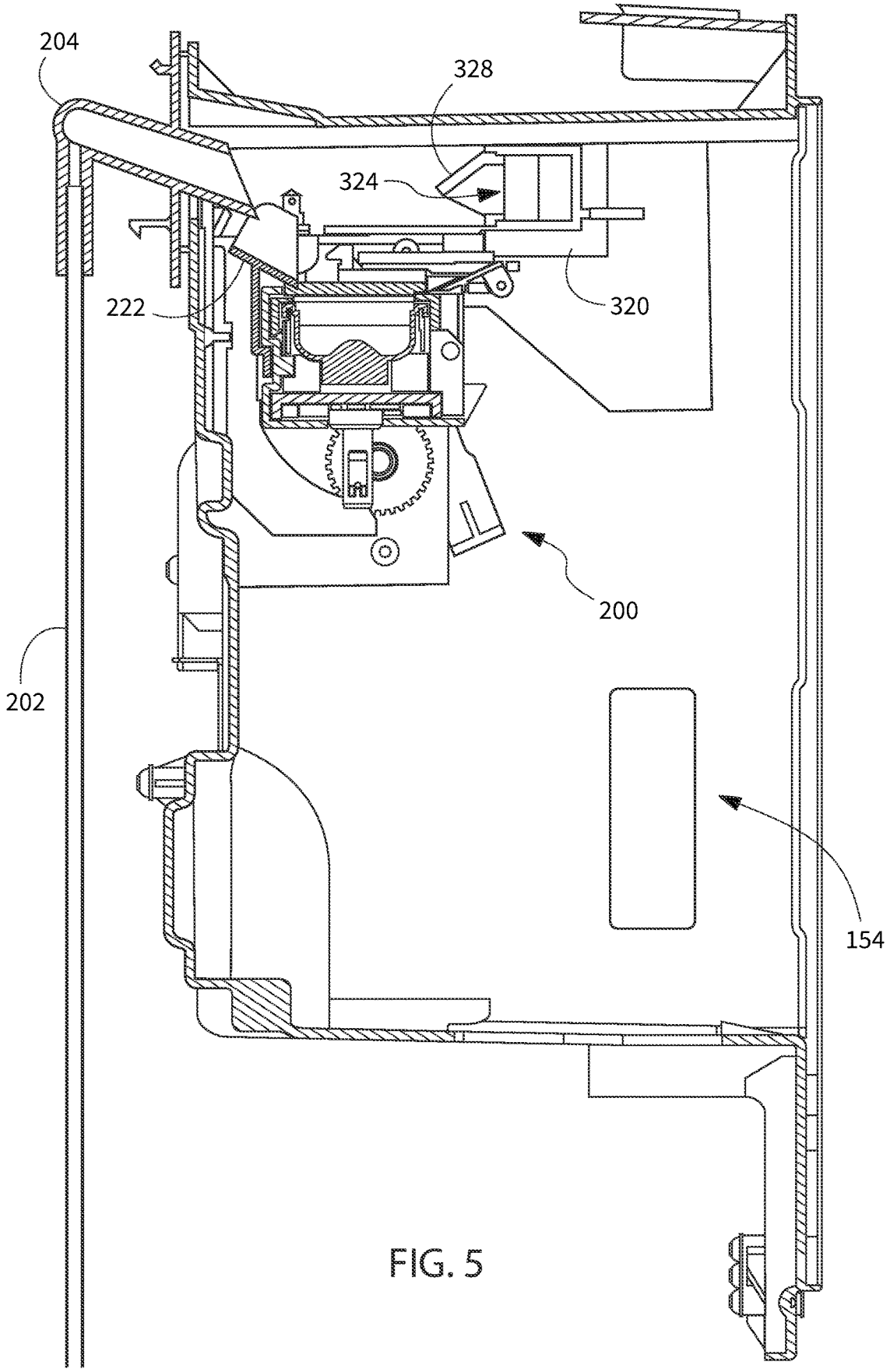
FIG. 5 provides a sectional view the exemplary door and ice making assembly of FIGS. 3 and 4.

Referring now to FIGS. 3 and 4, FIG. 3 provides an interior perspective view of one of the refrigerator doors 128 and FIG. 4 provides an interior elevation view of the door 128 with an access door 170 removed to more clearly depict the interior of the icebox 150. Refrigerator appliance 100 includes a sub-compartment 150 defined on refrigerator door 128. As mentioned above, the sub-compartment 150 may be referred to as an "icebox." In the illustrated exemplary embodiment, icebox 150 extends into fresh food chamber 122 when refrigerator door 128 is in the closed position. In additional embodiments, the icebox 150 may be positioned on a freezer door, such as a single freezer door (e.g., in a side-by-side configuration or standalone freezer), a front of a slidable freezer drawer, or one of a pair of freezer doors (such as in a quad door refrigerator configuration). As shown in FIG. 4, the ice making assembly 200 may be positioned within the icebox 150.

As mentioned above, an access door 170 may be hinged to the inside of the refrigerator door 128. Access door 170 permits selective access to icebox 150. Any manner of suitable latch 172 may be configured with icebox 150 to maintain access door 170 in a closed position. As an example, latch 172 may be actuated by a consumer in order to open access door 170 for providing access into icebox 150. Access door 170 can also assist with insulating icebox 150, e.g., by thermally isolating or insulating icebox 150 from fresh food chamber 122.

The ice making assembly 200 is generally configured for freezing the water to form ice, e.g., ice pieces such as ice cubes or other shapes, which may optionally be stored in a storage bin or other storage mechanism and dispensed through discharging outlet 146 by dispensing assembly 140. For example, the ice making assembly 200 may include a mols 210 having one or more mold cavities 226 (see, e.g., FIGS. 8-10 and 17) defined therein, such as in a removable cartridge 208 thereof (as will be described in further detail below), and liquid water may be directed into the mold cavity (or cavities) 226 of the ice making assembly 200, such as from a water supply line 202 and a nozzle 204. The ice making assembly 200 may include a fill cup 222 which may be generally aligned with the nozzle 204 to direct the liquid water to the mold 210. Such water may then be retained in the mold 210 at a temperature at or below the freezing point of water to form one or more ice pieces 1000. Chilled air from a sealed system (not shown) of refrigerator appliance 100 may be directed into or onto components, e.g., ice making assembly 200, within the icebox 150, in order to provide the temperature at or below the freezing point of water to form the ice piece or ice pieces 1000.

As mentioned above, the present disclosure may also be applied to other types and styles of refrigerator appliances such as, e.g., a top mount refrigerator appliance, a side-by-side style refrigerator appliance, or a standalone ice maker appliance. Variations and modifications may be made to ice making assembly while remaining within the scope of the present subject matter. Accordingly, the description herein of the icebox 150 on the door 128 of the fresh food chamber 122 is by way of example only. In other example embodiments, the ice making assembly may be positioned in the freezer chamber 124, e.g., of the illustrated bottom-mount refrigerator, of a side by side refrigerator, of a top-mount refrigerator, or any other suitable refrigerator appliance. As another example, the ice making assembly may also be provided in a standalone ice maker appliance. As used herein, the term "standalone ice maker appliance" refers to an appliance of which the sole or primary operation is generating or producing ice, e.g., without any additional or other chilled chambers other than the icebox, whereas the more general term "ice maker appliance" includes such appliances as well as appliances with diverse capabilities in addition to making ice, such as a refrigerator appliance equipped with an ice maker, among other possible examples.

The ice making assembly 200 may include a carriage 206 which is rotatable between a first position and a second position and a cartridge 208 which is removably mountable in the carriage 206. For example, the cartridge 208 may be removed and interchanged with a different cartridge 208 and/or a mold 210 of the cartridge 208 may be interchanged with another mold 210. For example, the mold 210 may be removably received in a frame 209 of the cartridge 208. Thus, in various embodiments, the mold 210 may be releasably received in the carriage 206 and/or cartridge 208. The cartridge 208 may be rotatable between a first position and a second position, e.g., the entire cartridge 208 may be rotatable with the carriage 206 between the first position and the second position when the cartridge 208 is releasably received in the carriage 206. In some embodiments, the rotation between the first position and the second position may be between about ninety degrees (90°) and about one hundred and seventy degrees (170°), such as between about one hundred and thirty degrees (130°) and about one hundred and sixty degrees (160°), such as about one hundred and fifty degrees (150°).

In some embodiments, e.g., as illustrated, the fill cup 222 may be connected to the carriage 206 and may be rotatable with the carriage 206. Accordingly, the ice making assembly 200 may be overall more vertically compact (e.g., as compared to a stationary fill cup design), which provides additional room below the ice making assembly 200, e.g., within icebox 150, such as may be used for a larger ice storage bin.

The cartridge 208 may include the mold 210 and one or more ejectors 238. The mold 210 may define one or more chambers or cavities 226 for formation of an ice piece 1000 therein and the ejector 238 may be positioned adjacent to the mold 210. In some embodiments, the mold 210 may be interlocked with the ejector 238. The ejector 238 may be configured to push the ice piece 1000 out of the cavity 226 as the cartridge 208 (e.g., the carriage 206 with the cartridge 208 releasably received therein) rotates between the first position and the second position. The mold 210 may be constructed from a flexible or resilient material, such as silicone rubber. Thus, the mold 210 may deform when pushed by the ejector 238 to aid in removal of the ice pieces 1000 from the mold 210.

Figure 10:
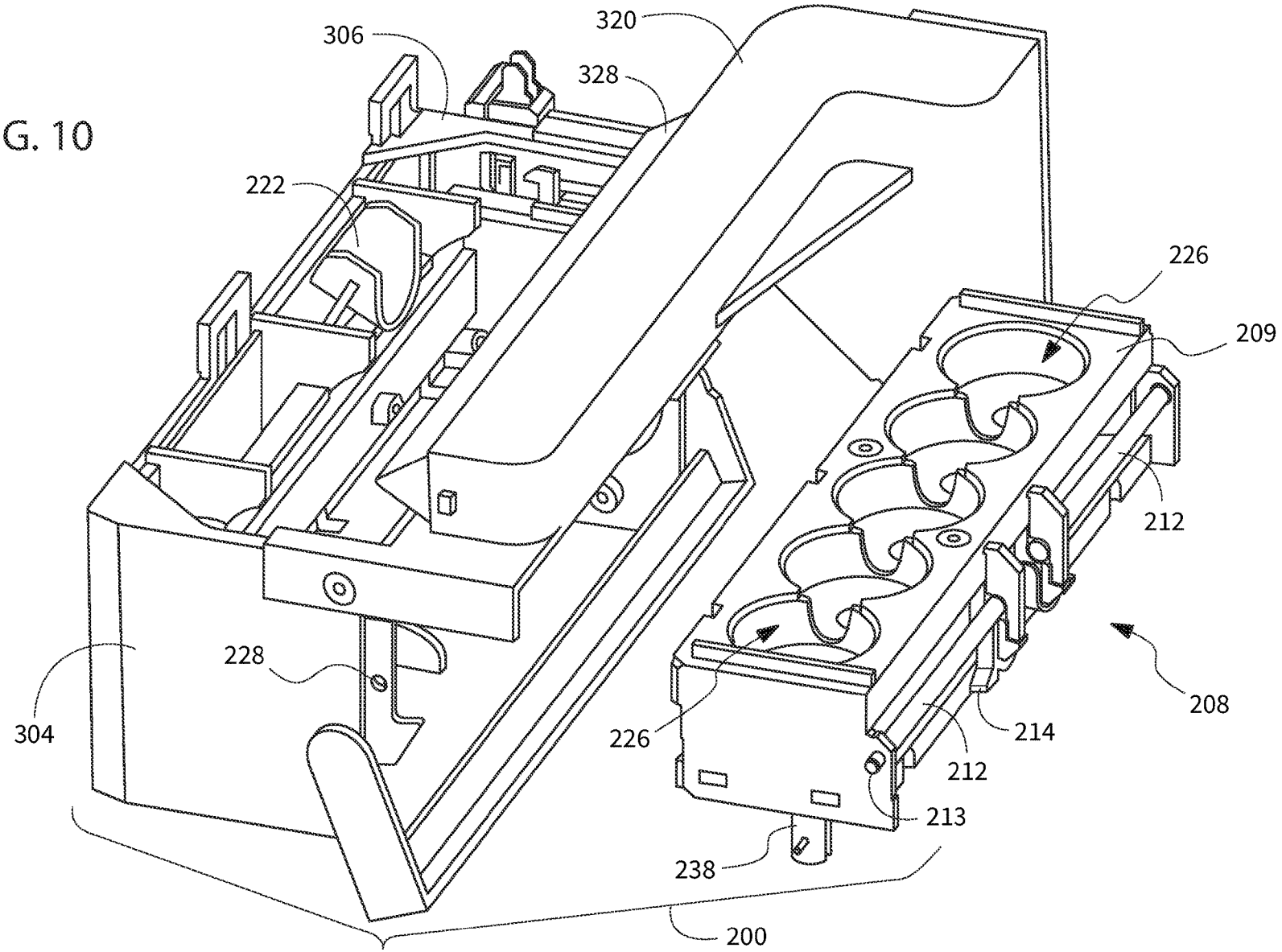
FIG. 10 provides a perspective view of the exemplary ice making assembly including a removable cartridge of the ice making assembly in a detached position.
Figure 11:
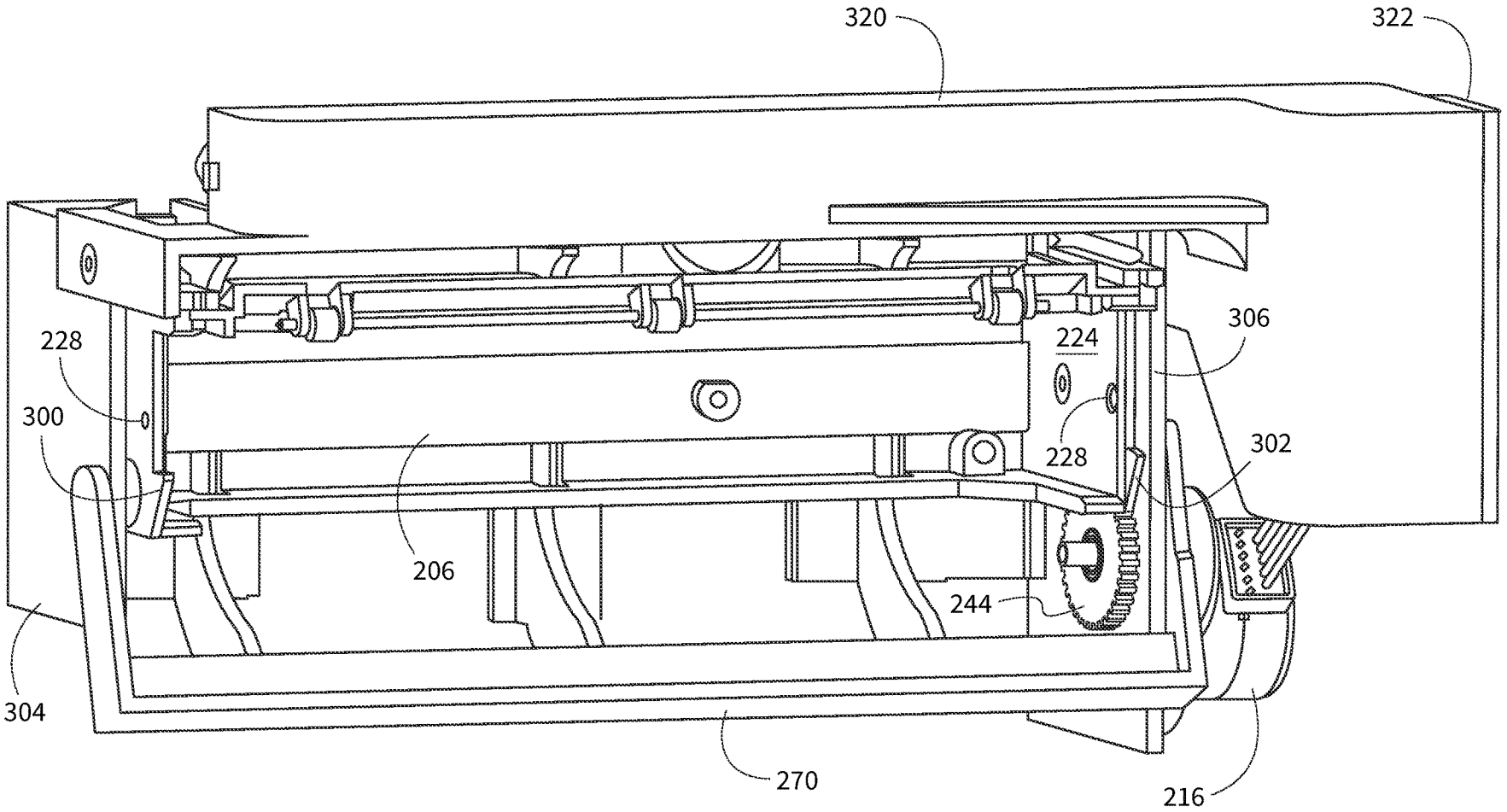
FIG. 11 provides a perspective view of the exemplary ice making assembly without the removable cartridge.
Figure 12:
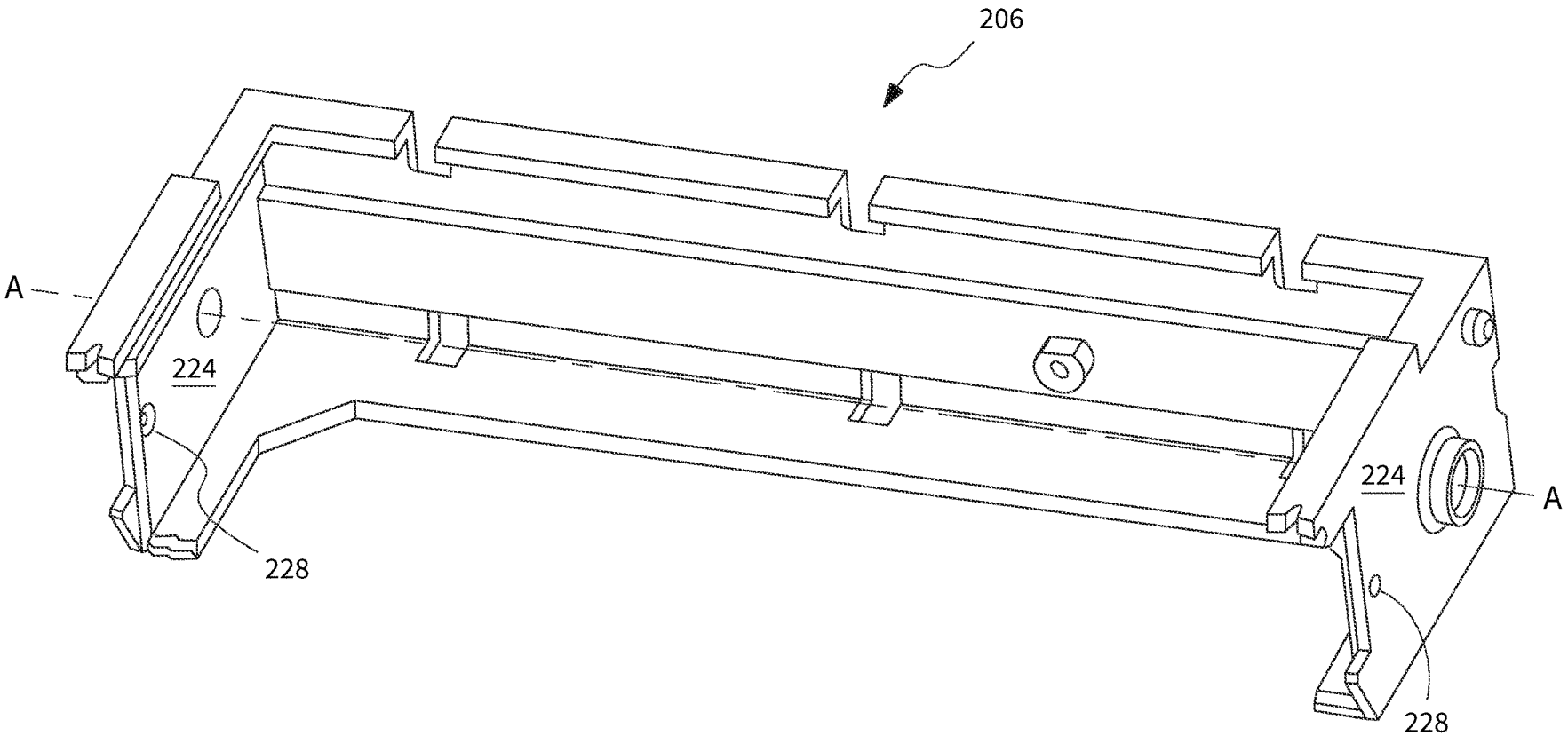
FIG. 12 provides a perspective view of a carriage of the exemplary ice making assembly.
Figure 13:
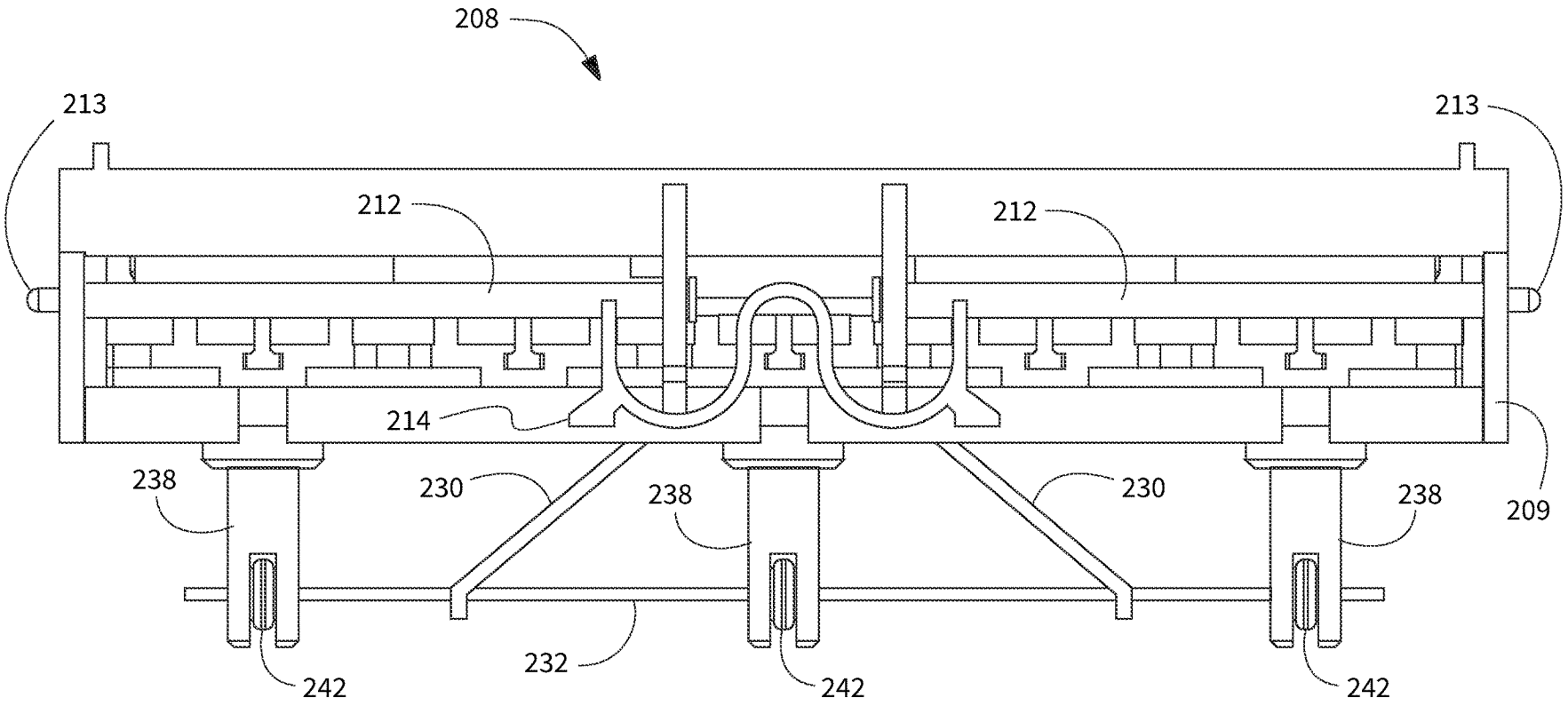
FIG. 13 provides a front view of the exemplary removable cartridge.
Figure 14:
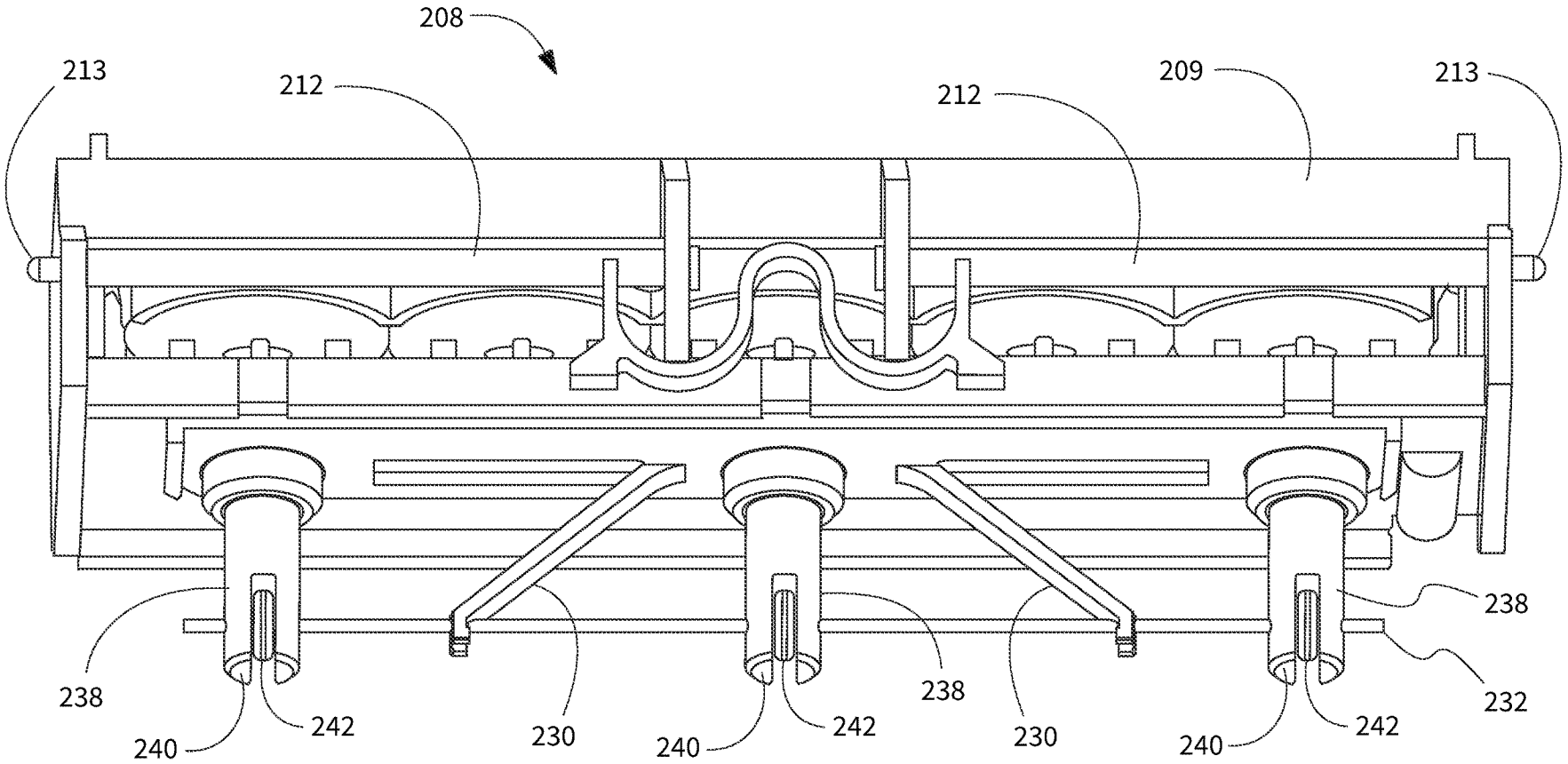
FIG. 14 provides a perspective view of the exemplary removable cartridge.
Figure 15:
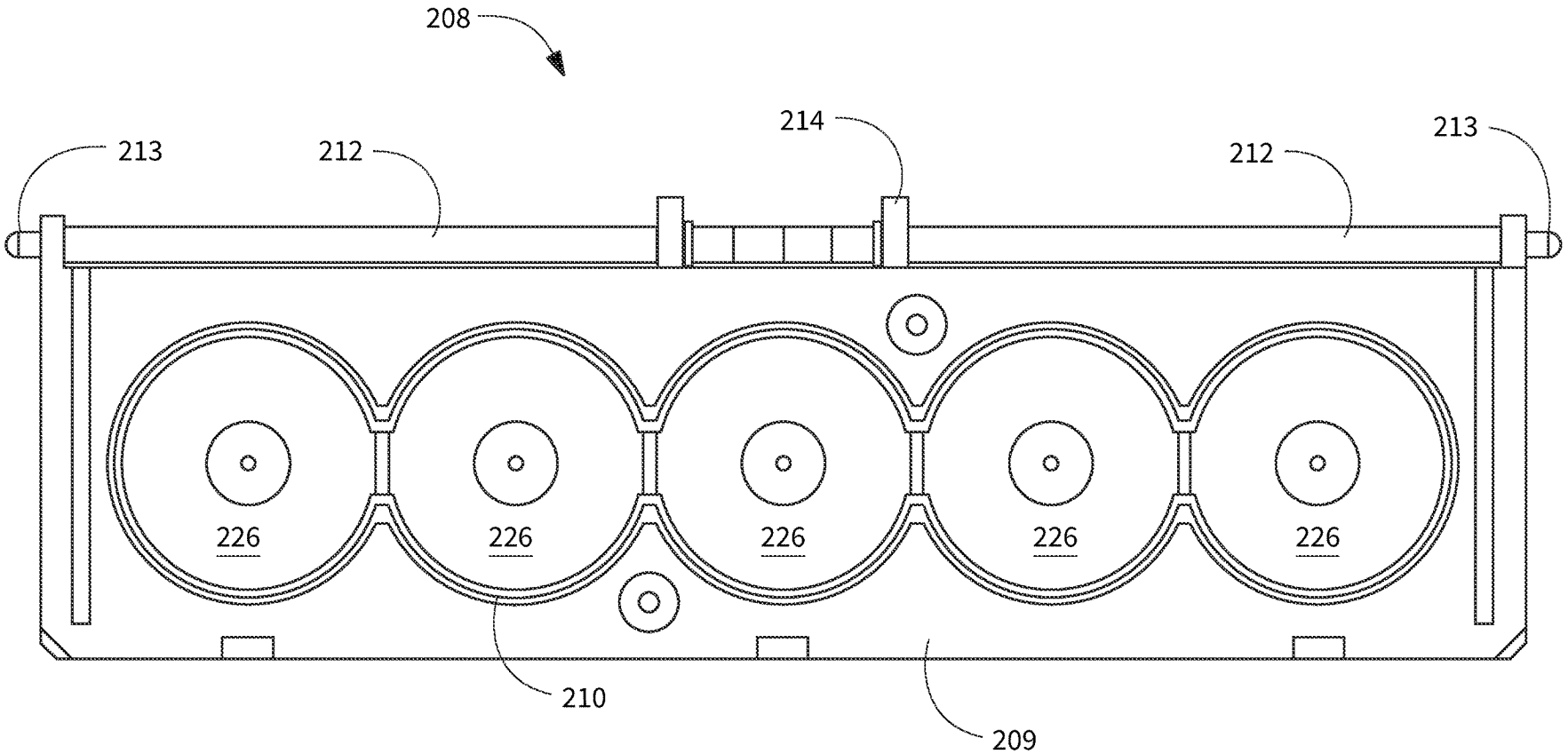
FIG. 15 provides a top view of the exemplary removable cartridge.
Figure 16:
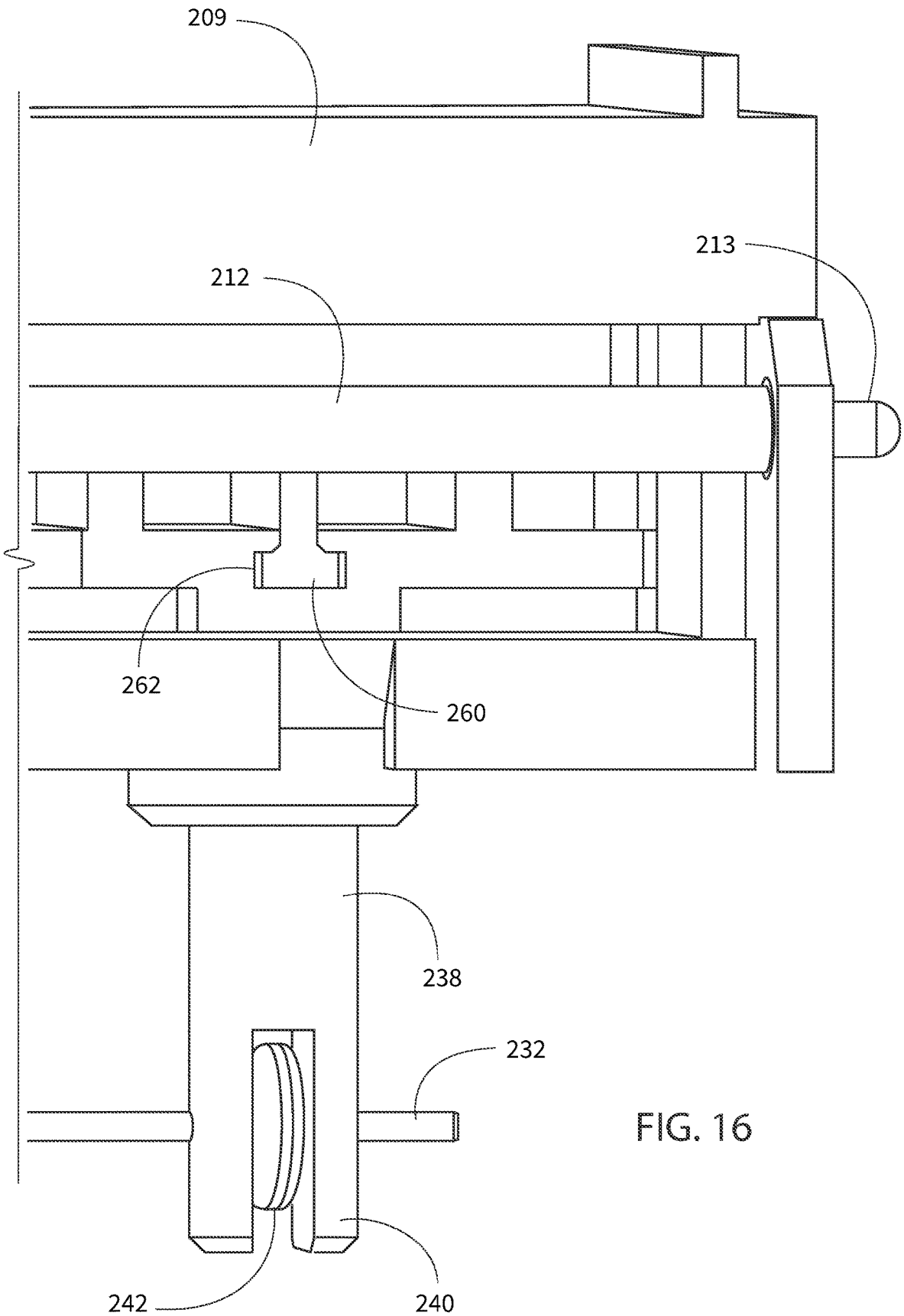
FIG. 16 provides a partial view of the exemplary removable cartridge.
Figure 17:
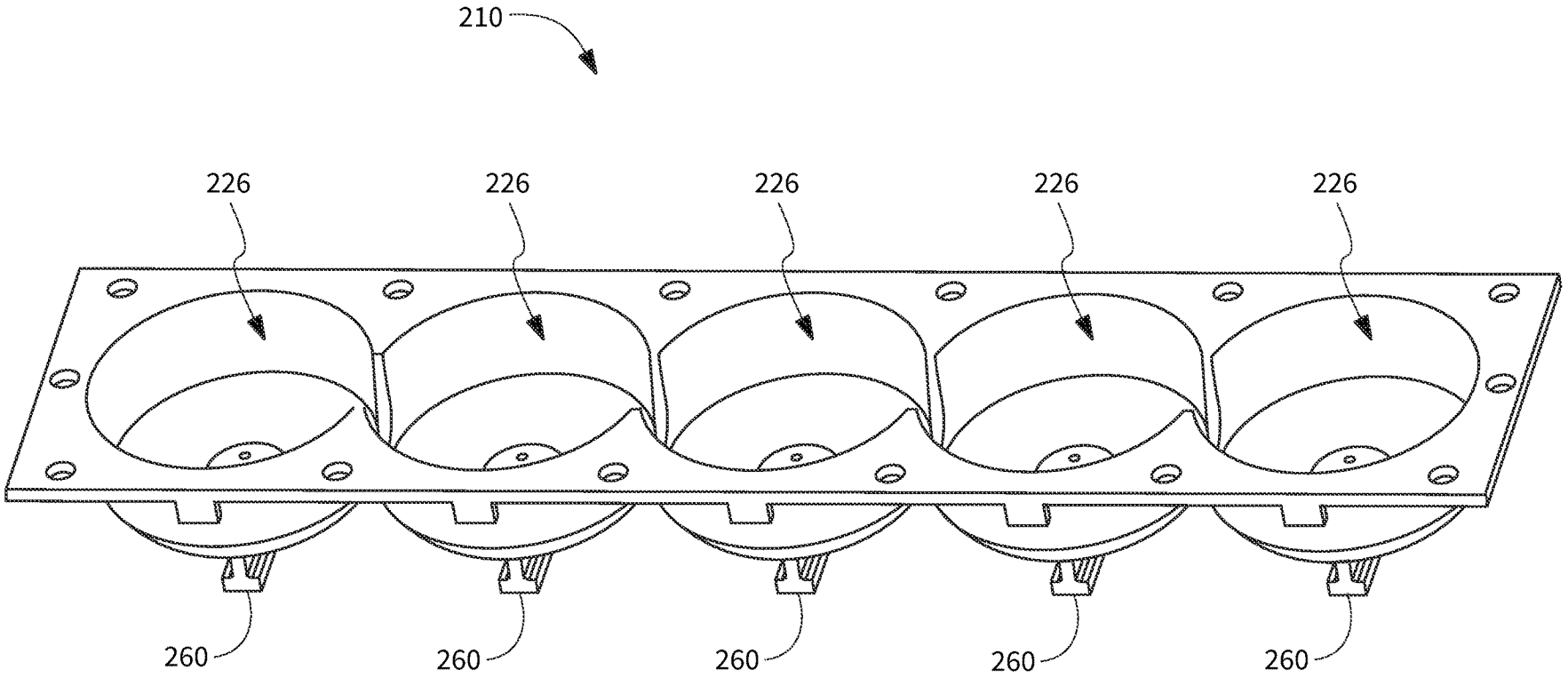
FIG. 17 provides a perspective view of a mold body of the exemplary removable cartridge.

Turning briefly to FIGS. 10-16, the cartridge 208 is shown removed from the remainder of the ice making assembly 200, e.g., removed the carriage 206, in FIG. 10. FIG. 11 illustrates the remainder of the ice making assembly 200 with the cartridge 208 removed, FIG. 12 illustrates the carriage 206 in isolation, and FIGS. 13-16 provide various views of an exemplary cartridge 208 by itself, e.g., separated and apart from the remainder of the ice making assembly 200.

Figure 20:
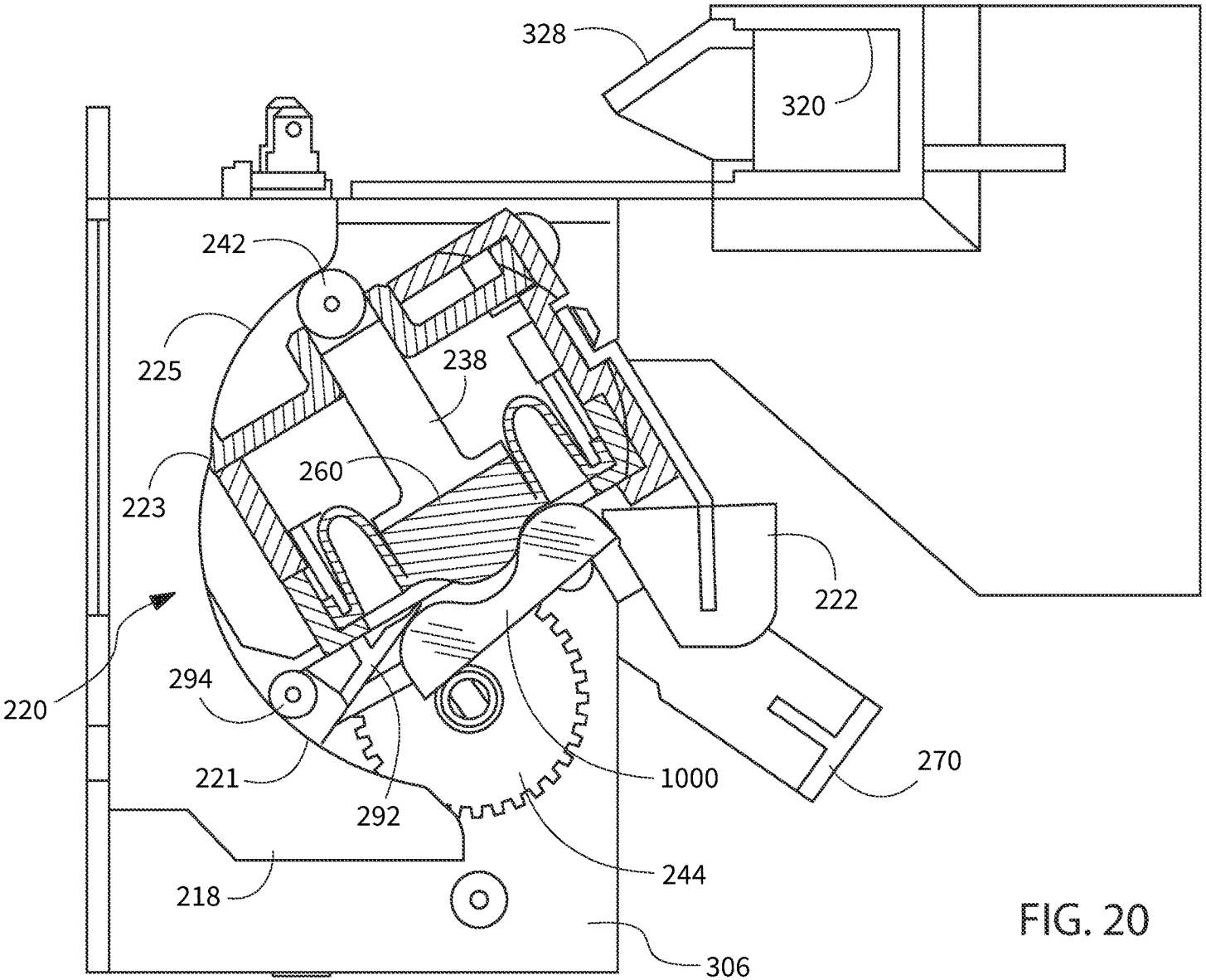
FIG. 20 provides a sectional view of the exemplary ice making assembly in a second position.

The cartridge 208 may be rotatable between a first position, e.g., a home position, (shown in FIGS. 4, 5, 6-8, and 19) and a second position, e.g., a harvest position in which ice pieces 1000 may be collected, e.g., harvested, from the mold 210 (shown in FIG. 20). In the first position (e.g., home position), mold 210 can be filled with water from the water supply 202. For example, a valve (not shown) can be activated by controller 164 as part of an ice making process to provide the appropriate amount of water to flow into the mold 210 when the cartridge 208 with the mold 210 therein is in the upper position. In the harvest position, the one or more ice pieces 1000 are fully ejected from the mold 210. Ice pieces 1000 may be, e.g., ejected into an ice bin.

A motor 216 operated by controller 164 is used to rotate the carriage 206 (and cartridge 208 releasably received therein) between the first position (e.g., home position) and the second position (e.g., harvest position). For example, motor 216 may drive gears 244 so as to rotate the carriage 206 about an axis of rotation A-A (FIG. 12) between the first and second positions as desired. The direction of rotation of, e.g., a shaft (not shown) from motor 216 may be used to control the direction of rotation of gears 244 and therefore carriage 206 as determined by controller 164. The carriage 206 may be received between, and rotatable relative to, a left bracket 304 on one side of the carriage 206 and a right bracket 306 on an opposite side of the carriage 206. In some embodiments, a single unitary bracket may be provided to which the carriage 206 is mounted on both sides of the carriage 206.

As mentioned, the cartridge 208 may further include one or more ejectors 238 positioned adjacent to mold 210. The ejector(s) 238 may be rotatable with the carriage 206 and cartridge 208 between the first position and the second position. As will be explained, the ejectors 238 are configured to push ice pieces 1000 out of mold 210 during rotation between the first position and the second position. More particularly, the ejectors 238 are configured to move between a retracted position (see, e.g., FIGS. 4, 5, 6, 7, 10, 13, 14, 16, and 19) and an extended position (shown in FIG. 20). Ejectors 238 move from the retracted position to the extended position as cartridge 208 is moved from the first position (e.g., home position) to the second position (e.g., harvest position), respectively. As may be seen in FIG. 20, and as will be further described below, the mold 210 may be formed at least partly from a flexible material, and such flexible material of the mold 210 may deform when the ejector 238 pushes the ice piece 1000 out of the cavity 226.

For this exemplary embodiment, movement of ejectors 238 is determined by a cam 218, e.g., the ice making assembly 200 may include one or mores cams 218, and each cam 218 may be in mechanical communication with one respective ejector 238. More particularly, a terminal end 240 (see, e.g., FIG. 14) of ejector 238 includes a cam follower or wheel 242 that rides along an arcuate path 220 defined by cam 218. The arcuate path 220 determines the position of ejector 238 as the cartridge rotates from the first position to the second position.

An exemplary method of operating ice making assembly 200 will now be set forth using the described exemplary embodiment. One of skill in the art, using the teachings disclosed herein, will understand that other exemplary methods of operation may be used as well.

Figure 27:
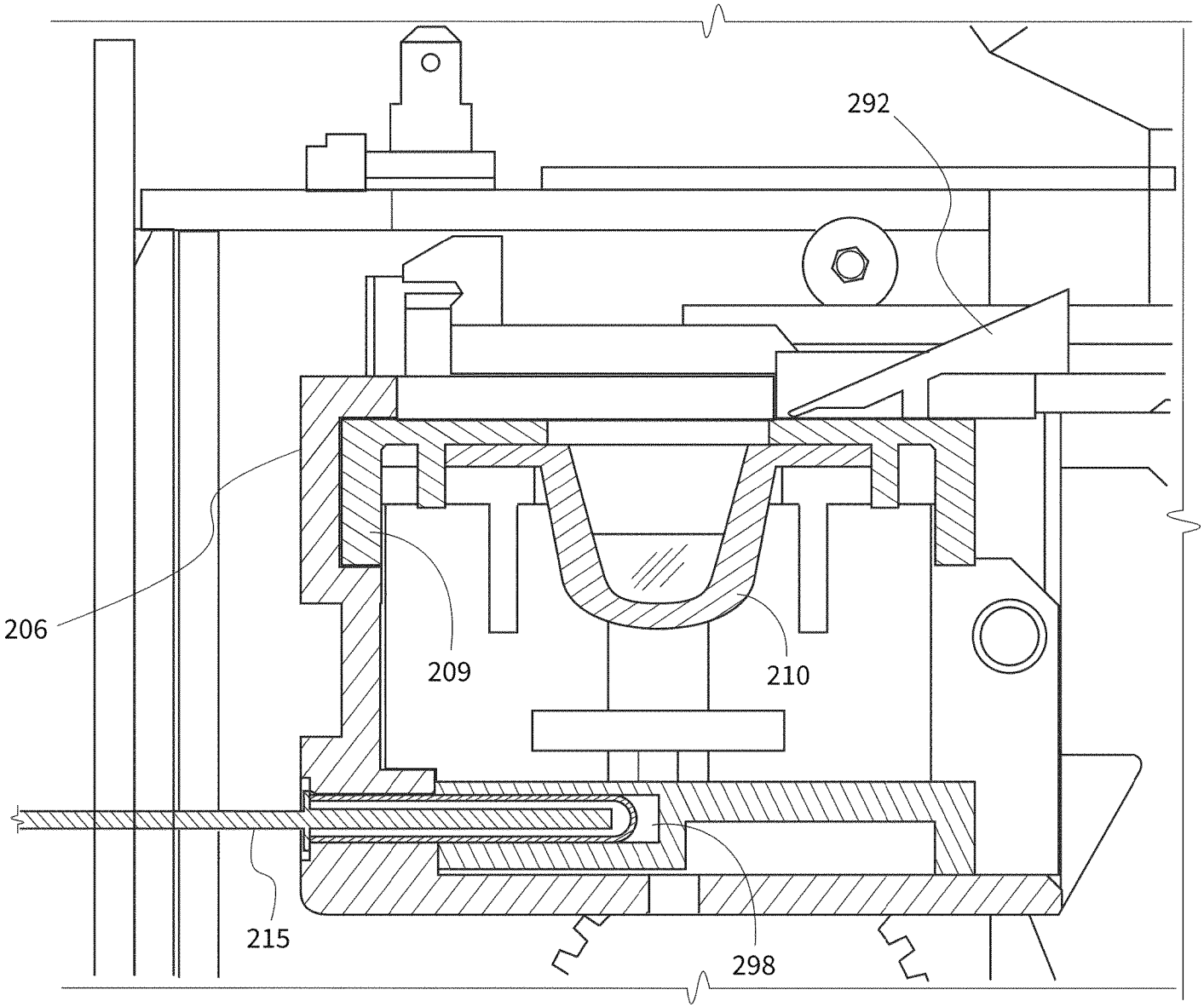
FIG. 27 provides a sectional view of a portion of the exemplary ice making assembly.

After mold 210 has been filled with an appropriate amount of water as previously described, the liquid water is allowed to freeze. During the filling and freezing process, the cartridge is maintained in the first position, e.g., mold 210 remains in the first position and ejector 238 remains in the retracted position. In one exemplary aspect of the invention, water may be filtered to remove particulates and may be cooled along a controlled temperature and time profile to provide clearer ice. Temperature (as measured by one or more sensors, e.g., sensor 215 as illustrated in FIG. 27) may be monitored so that, e.g., controller 164 may determine when the liquid water has been converted into ice pieces 1000.

After a determination has been made that the liquid water has frozen to form ice pieces 1000, controller 164 is configured and operable to activate motor 216 to begin rotation of the carriage 206 (and, consequently, the cartridge 208 therein). As the cartridge 208 rotates about axis of rotation A-A, ejector 238 is urged to the extended position. As the cartridge 208 rotates, ejector 238 moves along a direction perpendicular to axis of rotation A-A (e.g., a radial direction). Rotation forces ejector 238 to so move because cam follower 242 is riding on acuate path 220.

While rotation of the cartridge 208 continues, ejector 238 begins to deform flexible mold 210. Continued rotation increases the movement of ejector 238 and the deformation of mold 210. Ice pieces 1000 are also rotated and are forced to move in the same direction as ejector 238 by the pressing of ejector 238. As the cartridge 208 reaches the second position shown in FIG. 20, ejector 238 reaches the extended position so as to force ice pieces 1000 to be fully ejected from mold 210. The cartridge 208 may also include one or more biasing elements, e.g., leaf springs 230, in mechanical communication with the ejector 238. The biasing element(s) may be configured to urge the ejector from the extended position to the retracted position, e.g., the biasing elements may be compressed as ejector 238 is extended and then urge ejector 238 back to its retracted position when the carriage 206 (and cartridge 208 therein) rotates back to the first position.

In some embodiments, the cartridge 208 may include a latch, and the latch may releasably engage the carriage 206 while the cartridge 208 is received in the carriage 206. As may be seen in FIGS. 6 and 7 for example, the cartridge 208 may include one or more latch pistons 212, such as two latch pistons 212 as in the illustrated exemplary embodiment, which are releasably engaged with through holes 228 (see, e.g., FIGS. 10-12) formed through opposing side walls 224 of the carriage 206. The latch pistons 212 may each include a tip 213 (see, e.g., FIGS. 13-15) which is sized to extend into a corresponding through hole 228 and thereby engage the latch piston 212 with the through hole 228 (e.g., based on the outer diameter of the tip 213 less than the inner diameter of through hole 228). The latch pistons 212 may be movable, e.g., linearly, such as generally along a direction perpendicular to the vertical direction V, between an engaged position (e.g., FIGS. 6 and 7) where the latch pistons 212 are each received in a respective one of the through holes 228 and a release position in which the latch pistons 212 move away from the side walls 224 of the carriage 206, such as towards each other as in the illustrated exemplary embodiment. For example, the latch pistons 212 may be coupled to an actuator 214, e.g., which may be manually actuated, such as by pinching by a user, in order to disengage the latch pistons 212 from the side walls 224 of the carriage 206 and thereby permit removal of the cartridge 208 from the carriage 206. Thus, the cartridge 208 may be releasably received in the carriage 206 in that the cartridge 208 is held in the carriage 206 by engagement of the latch pistons 212 with the side walls 224 of the carriage 206, and the cartridge 208 may be releasable by actuating, e.g., manually pinching, the actuator 214 to pull the latch pistons 212 out of the through holes 228 and thereby disengage the cartridge 208 from the carriage 206, permitting removal of the cartridge 208 from the carriage 206.

Figure 8:
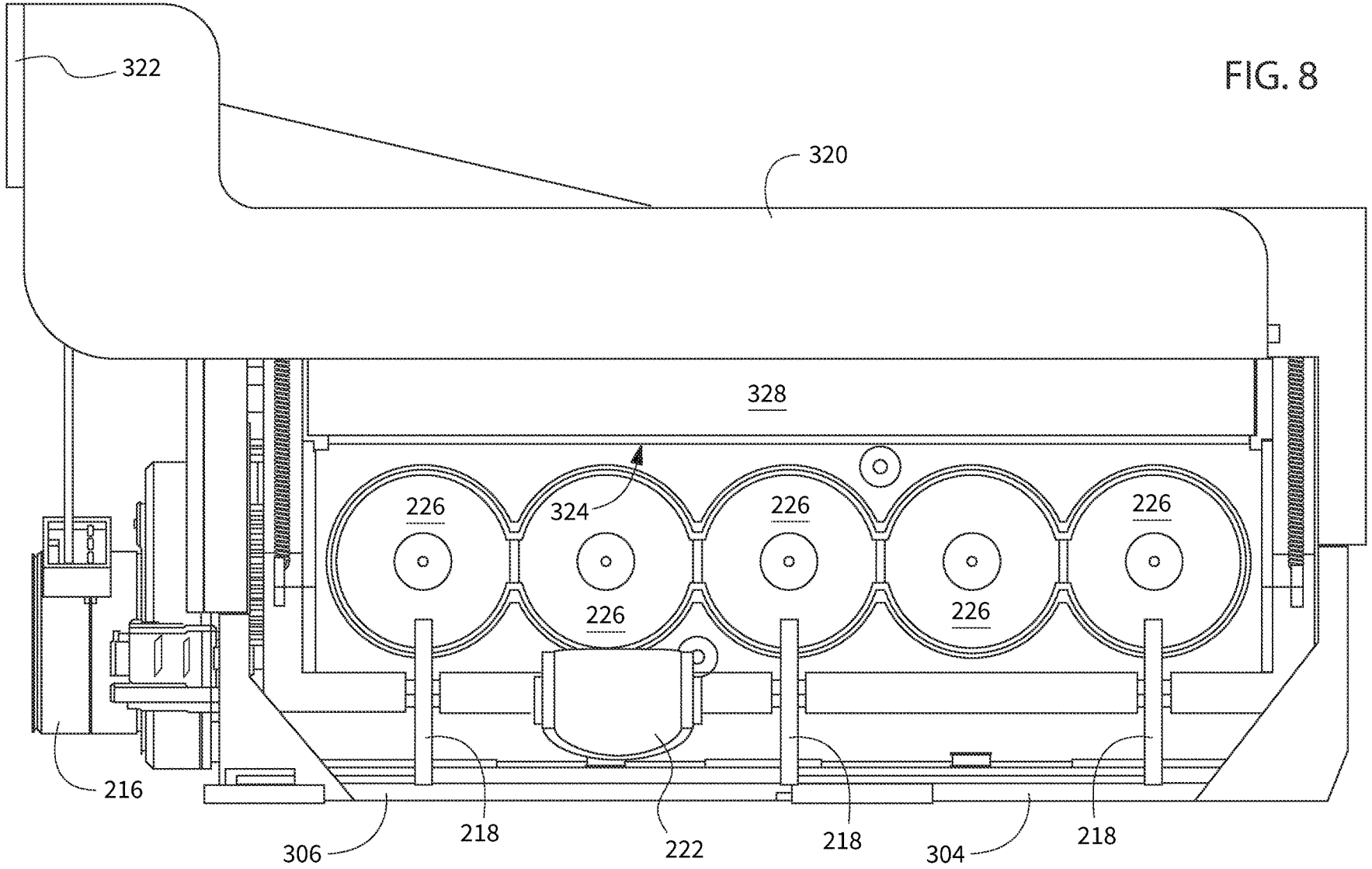
FIG. 8 provides a top view of the exemplary ice making assembly.
Figure 9:
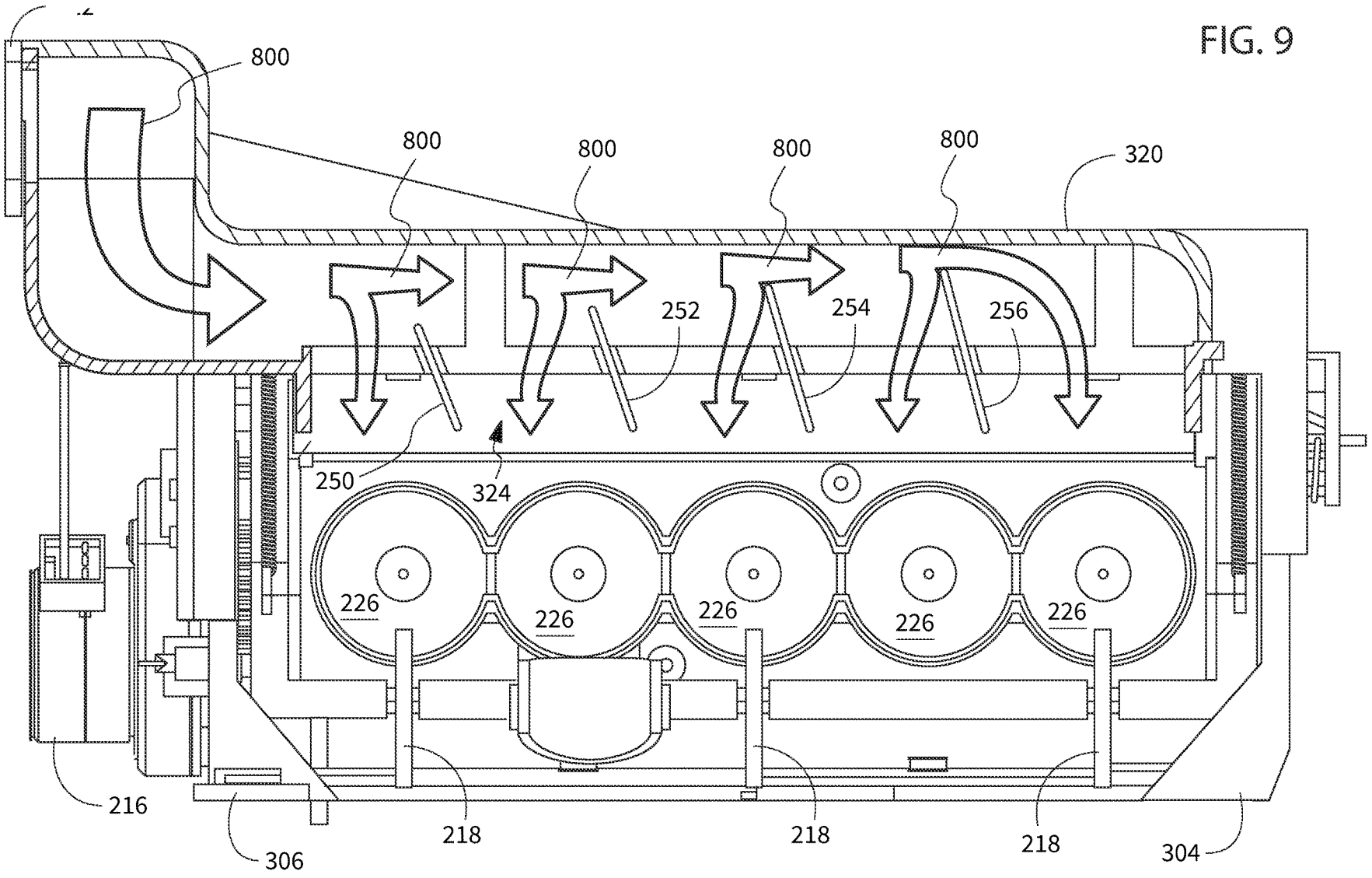
FIG. 9 provides a sectional view of the exemplary ice making assembly taken along a horizontal plane.

As may be seen, e.g., in FIGS. 8 and 9, the ice making assembly 200 may include a duct 320 configured to receive a flow of chilled air 800 (FIG. 9), e.g., from an evaporator of the refrigerator appliance 100 or another suitable chilled air source (such as a dedicated ice making evaporator, e.g., in some refrigerator embodiments and/or embodiments where the ice making assembly 200 is provided in a stand-alone ice making appliance). The duct 320 may be further configured to direct the flow of chilled air 800 to or towards the mold 210.

The duct 320 may extend from an inlet 322 to an outlet 324. The inlet 322 may be configured to sealingly mate with a conduit (not shown) which extends from a mechanical compartment or freezer chamber or other location to provide fluid communication from an evaporator to the duct 320 whereby the duct 320 receives the flow of chilled air 800 from the evaporator. For example, the conduit may extend through a wall of the icebox 150, such as an outlet of the conduit may be positioned at the wall of the icebox 150 and the inlet 322 of the duct 320 may connect to the outlet of the conduit, e.g., sealingly mate to the outlet as mentioned, at the wall of the icebox 150 (see, e.g., FIG. 4).

The outlet 324 of the duct 320 may be positioned above the mold 210 (e.g., when the mold 210 is received in the cartridge 208 and the cartridge 208 is, in turn, received in the carriage 206). The ice making assembly 200 may further include a hood 328 coupled to the duct 320 at the outlet 324 of the duct 320, such as over the outlet 324, and the hood 328 may be angled downward (such as at an angle oblique to the vertical direction V) to direct the flow of chilled air 800 from the outlet 324 of the duct 320 towards the mold 210.

In some embodiments, e.g., as may be seen in the section view illustrated in FIG. 9, the duct 320 may include a plurality of diverters therein. Each diverter of the plurality of diverters may extend to or towards the outlet 324, such that each diverter directs a portion of the flow of chilled air 800 to a corresponding portion of the mold 210, e.g., the corresponding portion of the mold 210 may be the portion of the mold 210 which is downstream of the respective diverter along the direction of the flow of chilled air 800. The diverters may be staggered, such that each successive diverter along the direction of flow of the chilled air 800 redirects a generally equivalent portion of the flow of chilled air 800 to each section of the mold 210. For example, each diverter may define a length, such as from a first end oriented into the flow of chilled air 800 to a second end of the diverter at the outlet 324 of the duct 320. The length of each diverter may be greater than the length of the immediate upstream diverter, such as the length of each diverter may increase by the same amount relative to each prior diverter ("prior" meaning upstream with respect to the flow of chilled air 800 through the duct 320), thereby providing a generally equal flow of chilled air 800 to each portion of the mold 210. As illustrated in FIG. 9, in some embodiments, the plurality of diverters may include (in serial flow order along the direction of the flow of chilled air 800) a first diverter 250, a second diverter 252, a third diverter 254, and a fourth diverter 256. The first diverter 250 may the shortest diverter of the plurality of diverters, and the fourth diverter 256 may be the longest diverter of the plurality of diverters. For example, the second diverter 252 may be longer than the first diverter 250 by an amount, the third diverter 254 may be longer than the second diverter 252 by approximately the same amount, and the fourth diverter 256 may also be longer than the third diverter 254 by approximately the same amount.

In some embodiments, the mold 210 may be removable from the cartridge 208. For example, the mold 210 may be interchangeable with another mold having a different number, shape, and/or size of cavities 226 therein, e.g., for making various types of ice pieces 1000 as may be desired, such as for different beverages or other purposes. For example, as may be seen in FIGS. 16 and 17, the mold 210 may include one or more tabs 260 which are releasably receivable in corresponding slots 262 in the cartridge 208, such as in one of the ejectors 238. As mentioned, the mold 210 may be formed from a resilient, flexible material such as silicone rubber. Thus, the tabs 260 of the mold 210 may be inserted into the slots 262 in the ejectors 238 by pressing the tabs 260 into the slots 262, e.g., through a relatively narrow top opening of each slots 262 which compresses the resilient, flexible material of the tab 260 and into a wider bottom portion of the slot 262 into which the resilient, flexible material of the tab 260 expands to retain the tab 260 in the slot. Similarly, the tabs 260 of the mold 210 may be removed from the slots 262 in the ejectors 238 by pulling the tabs 260 from the slots 262, e.g., with sufficient force to deform the resilient, flexible material of the tab 260 as the tab 260 is drawn through the narrower upper portion of the slot 262 and out of the slot 262. In some embodiments where the mold 210 includes tabs 260 engaged in slots 262, the retraction of the ejectors 238 (e.g., as urged by biasing elements, e.g., springs 230) may promote returning the mold 210 to the original shape, e.g., re-forming the cavities 226 therein, such as the ejector 238 may push the mold 210 out of the original shape as the ejector 238 extends and then the ejector 238 may pull the mold 210, via the tabs 260, back into the original shape as the ejector 238 retracts.

Figure 18:
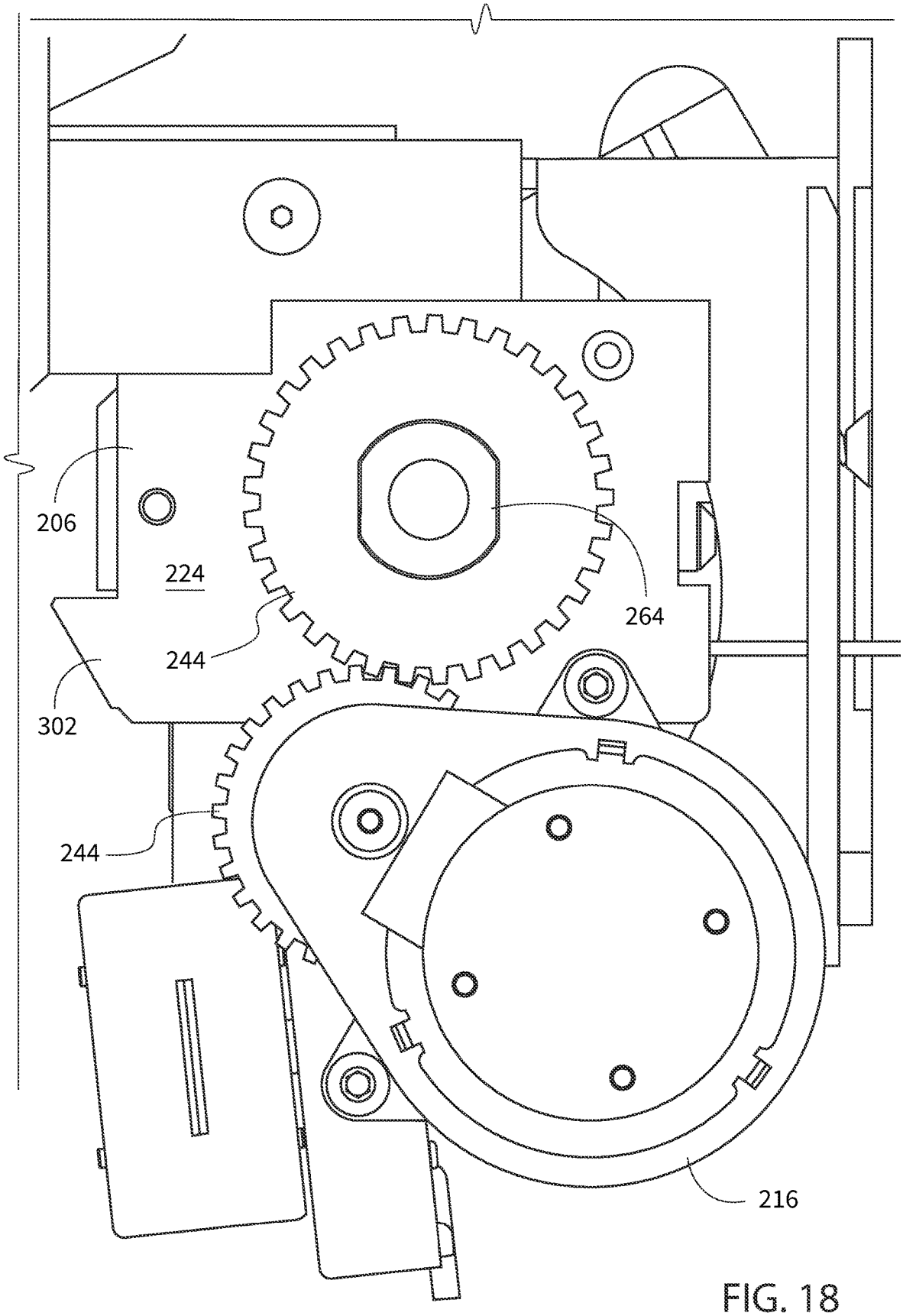
FIG. 18 provides a side view of the exemplary ice making assembly.
Figure 19:
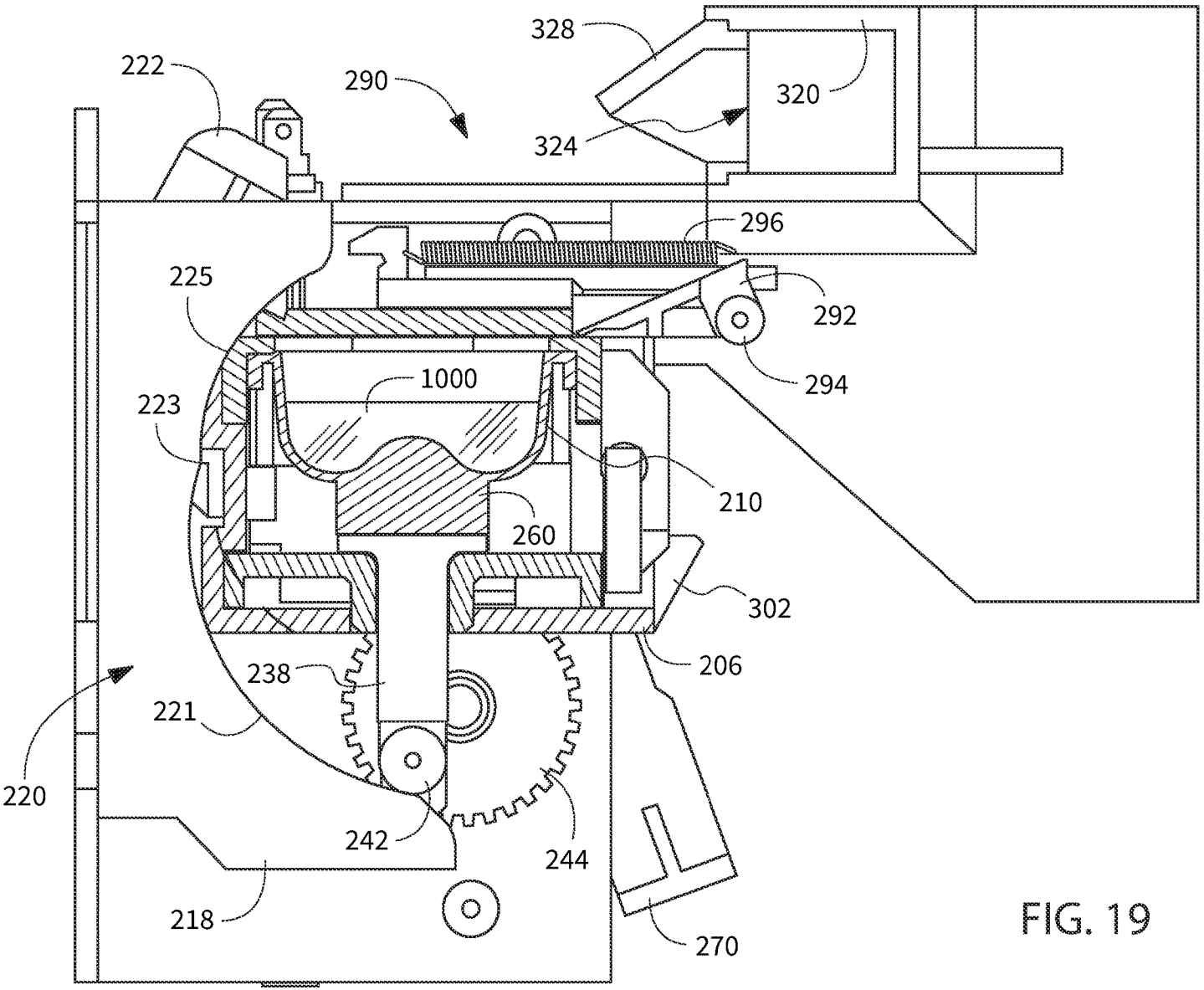
FIG. 19 provides a sectional view of the exemplary ice making assembly in a first position.

In some embodiments, the carriage 206 may include a first knob 264 (FIG. 18) thereon, such as projecting outward from an outer surface of one of the side walls 224 of the carriage 206, and a second knob 266 (FIG. 23), e.g., projecting outward from an outer surface of the other of the side walls 224 of the carriage 206. As may be seen in FIG. 23, the second knob 266 may have a circular cross-sectional shape, e.g., to permit the carriage 206 to rotate relative to an adjoining stationary portion of the ice making assembly 200. For example, second knob 266 may have a generally annular shape, e.g., a rounded, such as circular, overall shape with a central aperture. The second knob 266 may interact with a post (not shown) on the left bracket 304, such as the post on the left bracket 304 may be received within the central aperture of the second knob 266. Accordingly, the second knob 266 and left bracket 304 may cooperatively provide a supporting bearing that allows rotation around a horizontal axis (e.g., axis A-A noted in FIG. 12). As may be seen in FIG. 18, the first knob 264 may have at least one flat side (e.g., may have a discorectangular cross-sectional shape, or may have a truncated circular cross-sectional shape, e.g., as in the illustrated exemplary embodiment, or other combinations of curvilinear sides and flat sides), and one of the gears 244 may be mounted to the carriage 206 at the second knob 264, whereby rotation of the gear 244 driven by the motor 216 is transferred to the carriage 206 via the first knob 264. In FIG. 18, the right bracket 306 is omitted to more clearly show the positions of the motor 216, gears 244, and second knob 266.

As described above, such rotation of the carriage 206 provides ejection of the ice pieces 1000 from the mold 210. The carriage 206 may be rotatable between a first ("home") position (FIG. 19) and a second ("harvest") position (FIG. 20). As may be seen in FIGS. 19 and 20, the cam follower 242 rides along the arcuate path 220 defined by cam 218 as the carriage 206 and cartridge 208 rotate between the home position and the harvest position. The arcuate path 220 may be a compound curve, such as the arcuate path 220 may include a first portion 221 which has a decreasing radius such that the ejector 238 moves radially inward (e.g., towards the axis of rotation A-A indicated in FIG. 12) as the follower 242 moves along the first portion 221 of the arcuate path 220 from the home position. The arcuate path 220 may also include a second portion 225 which defines a constant radius, e.g., a circular arc, such that the radial position of the ejector 238 is maintained as the follower 242 moves along the second portion 225 of the arcuate path 220, e.g., as the rotation continues towards the harvest position. The compound curved arcuate path 220 may also include an inflection point 223 where the first and second portions 221, 225 adjoin each other. As will be described further below, the ice making assembly 200 may also include a sweep assembly 290, and the sweep assembly 290 may ride on the first portion 221 of the arcuate path 220 as the follower 242 rides on the second portion 225 of the arcuate path 220.

Figure 21:
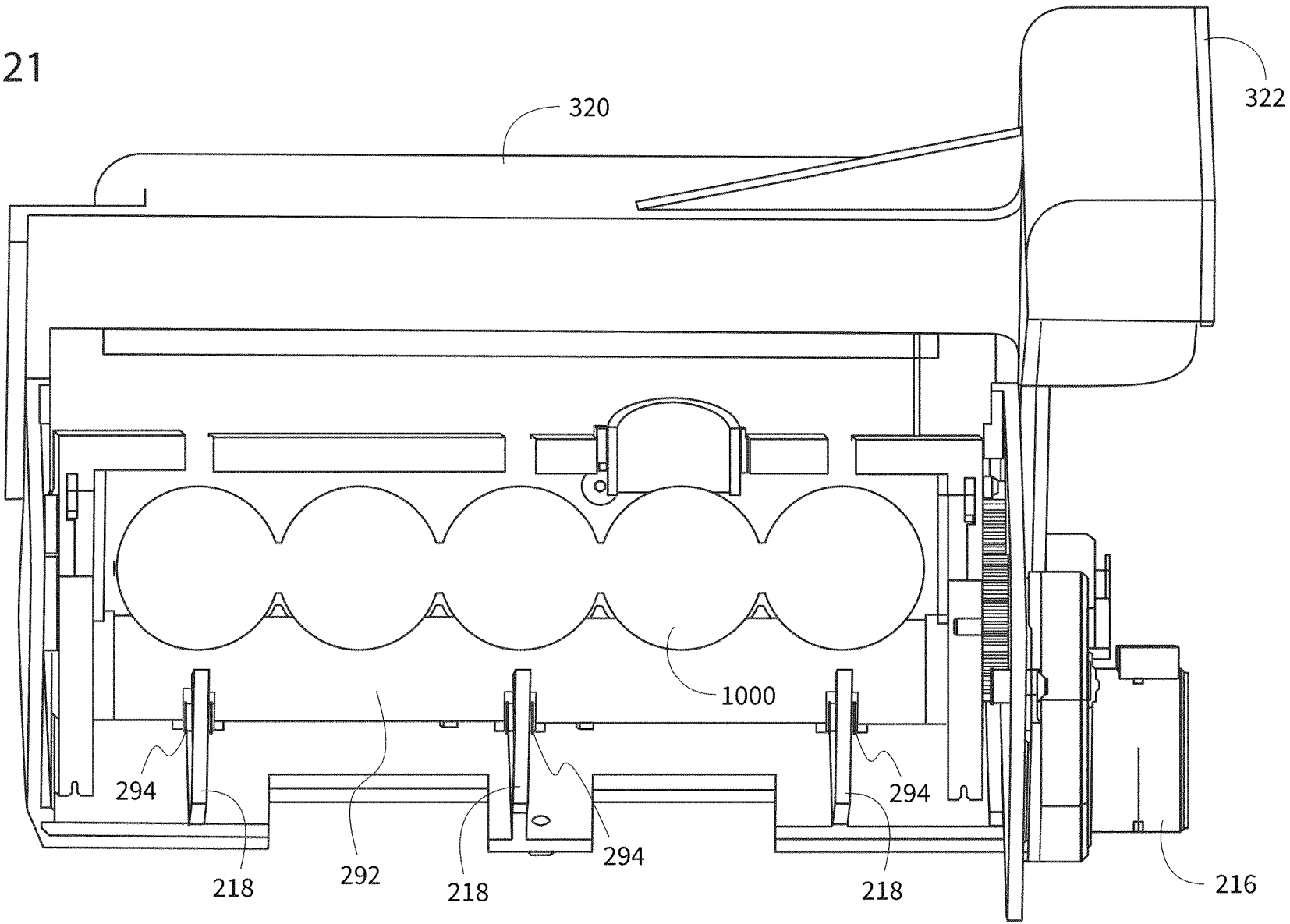
FIG. 21 provides a top view of the exemplary ice making assembly during a harvest operation.
Figure 22:
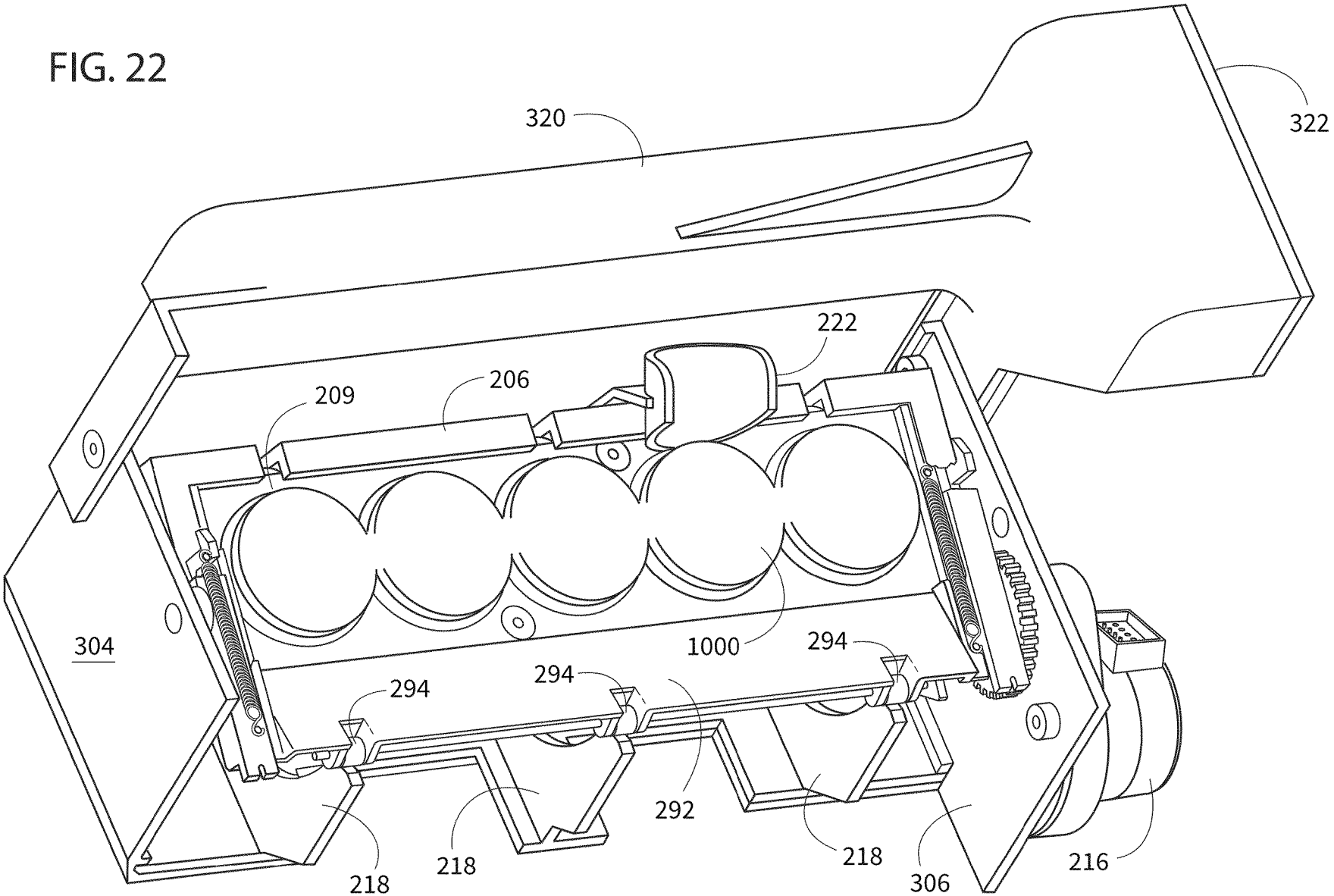
FIG. 22 provides a perspective view of the exemplary ice making assembly during the harvest operation.

The ice making appliance 200 may further include a sweep assembly 290. The sweep assembly 290, such as at least a wedge 292 thereof, may be configured to move across the mold 210, e.g., across a top surface of the mold 210 ("top" referring to the orientation of the mold 210 when received in the cartridge 208, the cartridge 208 is received in the carriage 206, and the carriage 206 is in the first position), when the carriage 206 rotates from the first position to the second position. As may be seen, e.g., in FIGS. 19 and 20, the sweep assembly 290 may include a wedge 292 with one or more wedge wheels or followers 294 mounted thereto. As may be seen in FIGS. 20 and 21, the wedge 292 may assist with harvesting ice pieces 1000 from the mold 210, such as by leveraging the ice pieces 1000 out of the cavities 226. In particular, as the carriage 206 (with the cartridge 208 mounted therein) continues to rotate towards the harvest position as described above, e.g., when the cam follower 242 of the ejector 238 rides along the second portion 225 of the arcuate path 220, the follower 294 of the wedge 292 may ride along the first portion 221 of the arcuate path 220, such that the decreasing radius of the first portion 221 pushes the follower 294 and the wedge 292 therewith radially inward as the carriage 206 rotates to the harvest position. For example, the followers 294 of the sweep assembly 290 are illustrated in FIG. 22 in a position where the followers 294 have just reached a first end of each respective cam 218 while travelling towards the second position. The sweep assembly 290 may thus sweep across the frame 209 and mold 210 of the cartridge 208 while rotating to the harvest position, such that the wedge 292 aids in removal of the ice pieces 1000 from the mold 210. The sweep assembly 290 may also include one or more biasing elements 296, e.g., compression springs, which are configured to urge the wedge 292 back to the home position after the carriage 206 rotates far enough towards the home position from the harvest position for the followers 294 on the wedge 292 to clear the cam 218.

Figure 6:
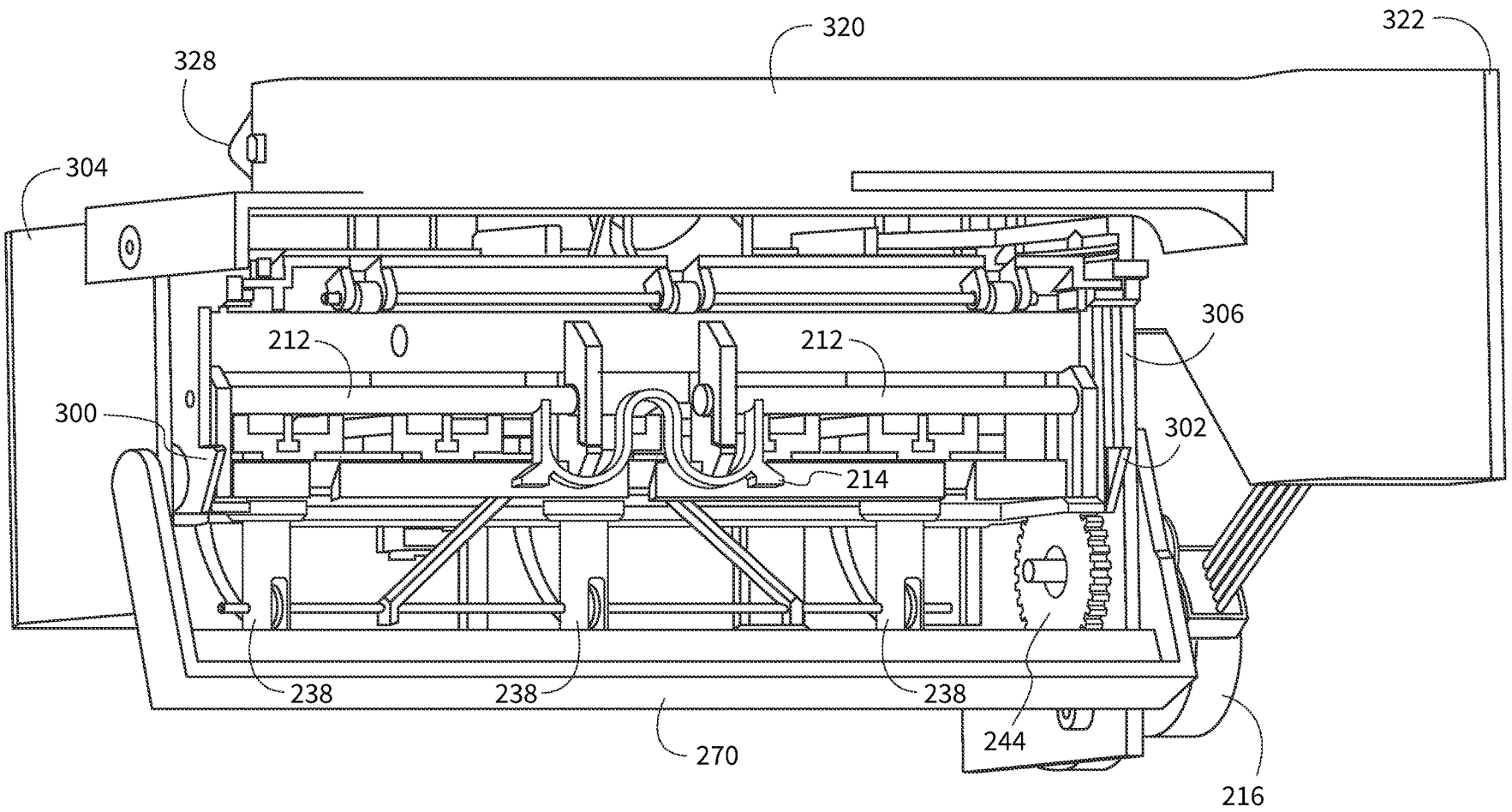
FIG. 6 provides a perspective view of the exemplary ice making assembly.
Figure 7:
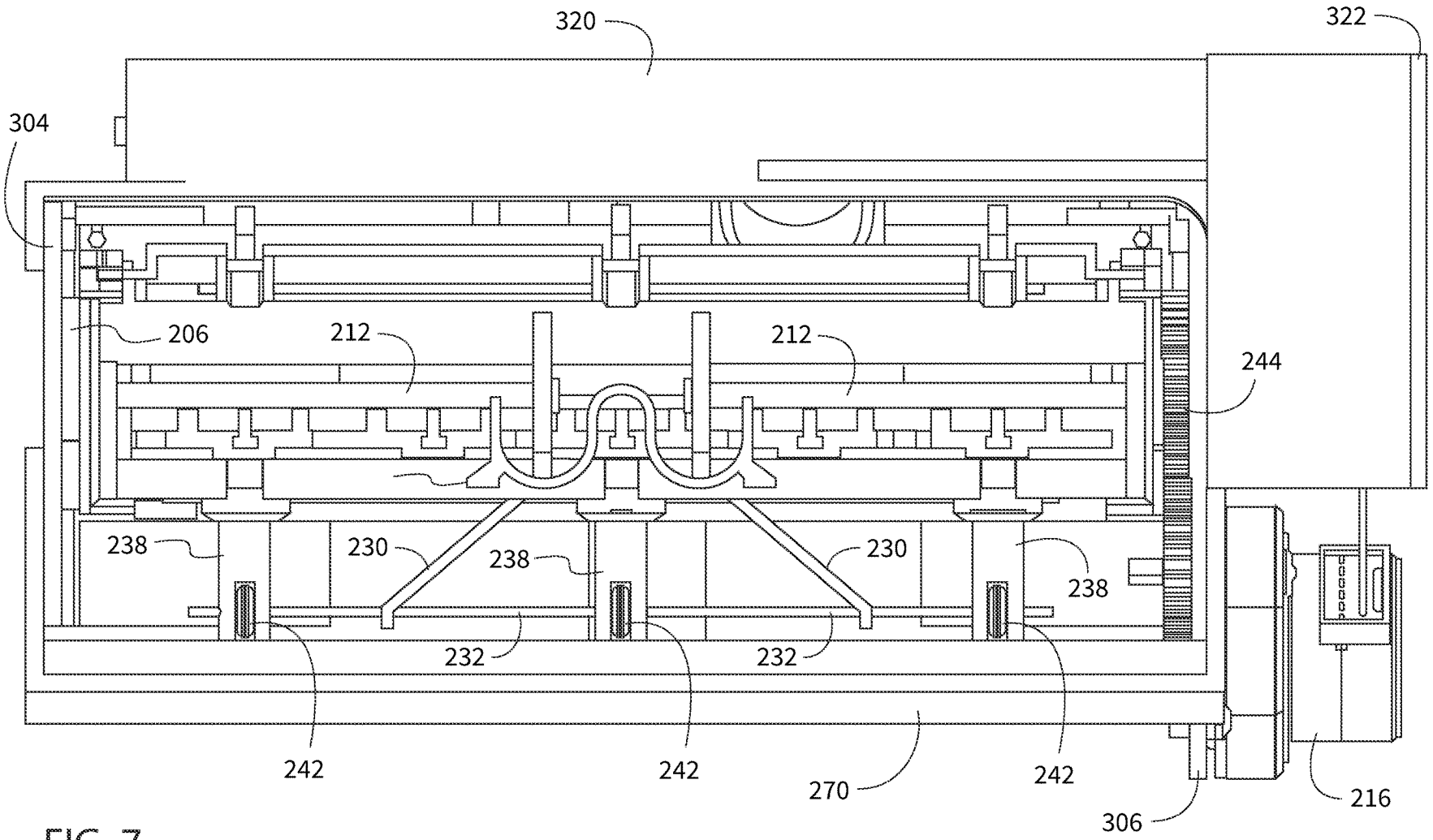
FIG. 7 provides a front view of the exemplary ice making assembly.
Figure 23:
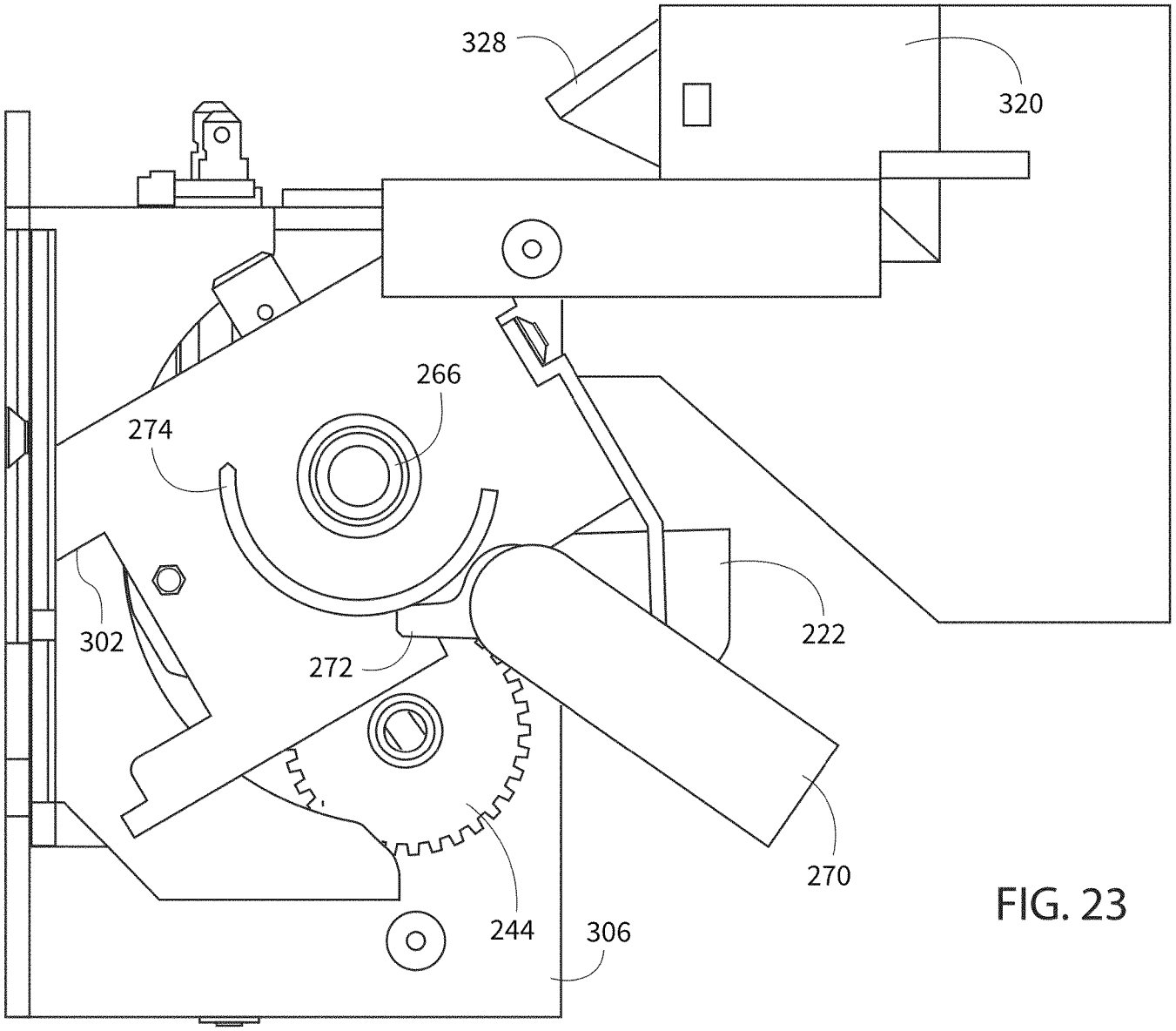
FIG. 23 provides another sectional view of the exemplary ice making assembly in the second position.

As may be seen, e.g., in FIGS. 6, 11, and 23, the ice making assembly may include a first stop 300 and a second stop 302 on the carriage 206. As may be best seen in FIG. 23, when the carriage 206 (and the cartridge 208 mounted therein) reach the second position, the stops 300 and 302 may abut the left bracket 304 and right bracket 306, such as may abut stops (not shown) on each respective bracket 304 and 306, and may thereby prevent or limit over rotation of the carriage 206 beyond the harvest position.

In some embodiments, the plurality of ejectors 238 may be linked by a rod 232, whereby the plurality of ejectors 238 generally move together, e.g., between the first position (home position) and the second position (harvest position). The ice making assembly 200 may further include one or more springs 230, such as leaf springs, which engage rod 232 to urge the rod 232, and each of ejectors 238 with it, downward to return to the home position and re-form the mold cavities 226 (e.g., the flexible material of the mold 210 returns to its original shape) when the carriage 206 and cartridge 208 rotate back to the home position. For example, re-forming the mold cavities 226 may permit a subsequent fill of liquid water into the mold cavities 226 to form more ice pieces 1000 therein, e.g., in a subsequent cycle of the ice making assembly 200. The springs 230 may be formed of any suitable material, such as a resilient plastic material.

Referring again to FIG. 23, the ice making assembly 200 may also include a feeler arm 270 which is rotatably mounted on the left bracket 304 and right bracket 306. The feeler arm 270 may be rotatable relative to the left bracket 304 and the right bracket 306. As may be seen, e.g., in FIGS. 4 and 5, the feeler arm 270 may be positioned generally at a front of the ice making assembly 200 and may be configured to extend, e.g., downward, into an ice storage volume, such as may be defined in an ice storage bin (not shown) below the carriage 206 while the carriage 206 is in the first position. As will be described in further detail, the feeler arm 270 may thus be positioned and configured to detect a fill level of the ice storage bin, such as the feeler arm 270 may be configured to detect when the ice storage bin has reached a predetermined level, e.g., height, of ice therein which corresponds to a full status of the ice storage bin, while the carriage 206 is in the first position.

As may be seen, e.g., in FIG. 23, the feeler arm 270 may be attached, e.g., coupled, to a lever 272. The lever 272 may engage with and ride on a rib 274 on carriage 206 as the carriage rotates to the second position. The lever 272 may be configured to rotate the feeler arm upwards as the carriage rotates from the first position to the second position, e.g., engagement of the lever 272 with the rib 274 may rotate the feeler arm 270 upwards, allowing harvested ice pieces 1000 to pass below the feeler arm 270 and into an ice storage bin. When the carriage 206 returns to the home position, the lever 272 may slide off of the rib 274 on the carriage 206, thereby permitting the feeler arm 270 to rotate downward. When the feeler arm 270 encounters ice pieces 1000 before rotating all the way downward, the full ice storage bin may be thereby detected.

Figure 24:
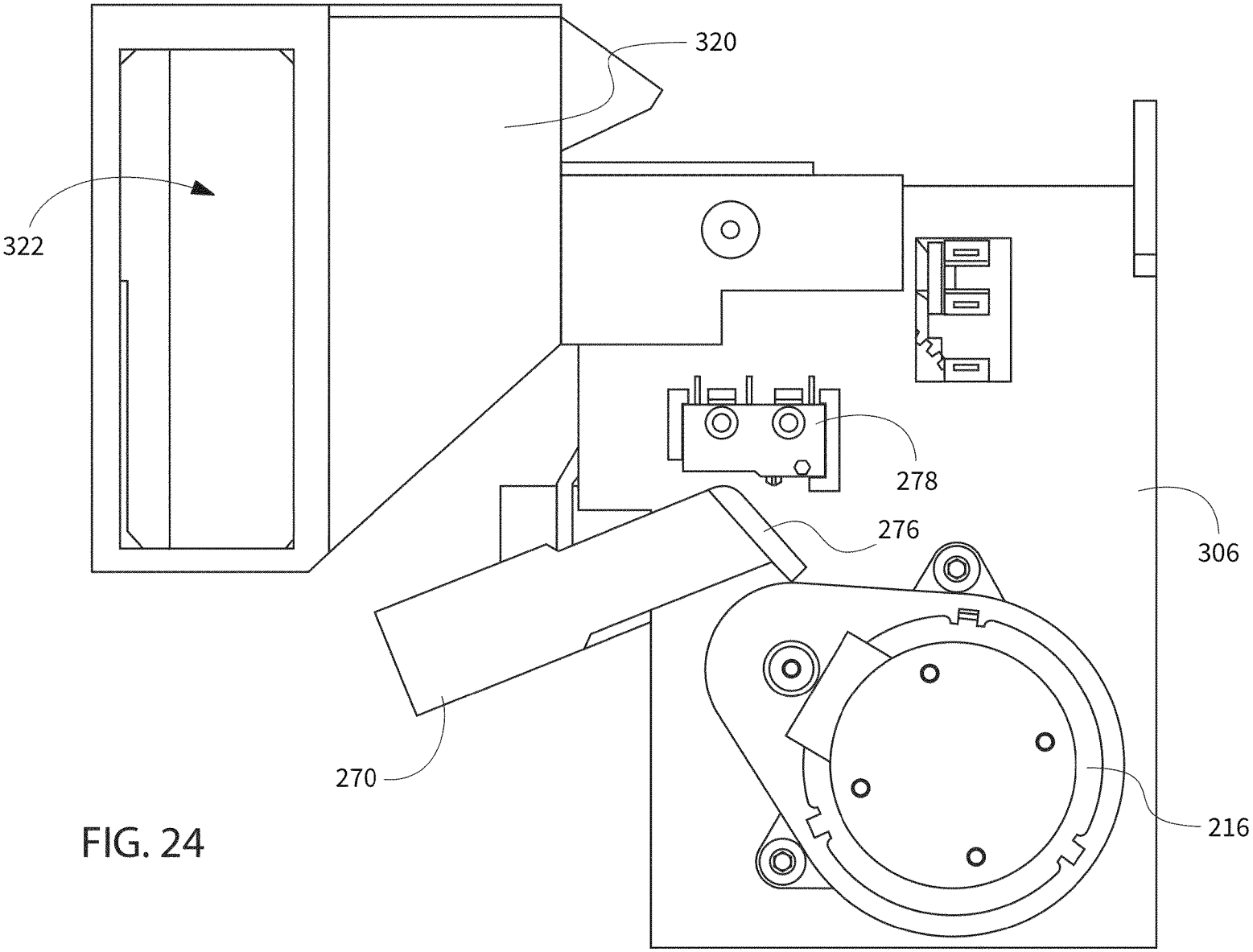
FIG. 24 provides a side view of the exemplary ice making assembly with a feeler arm of the ice making assembly in a second, e.g., up, position.
Figure 25:
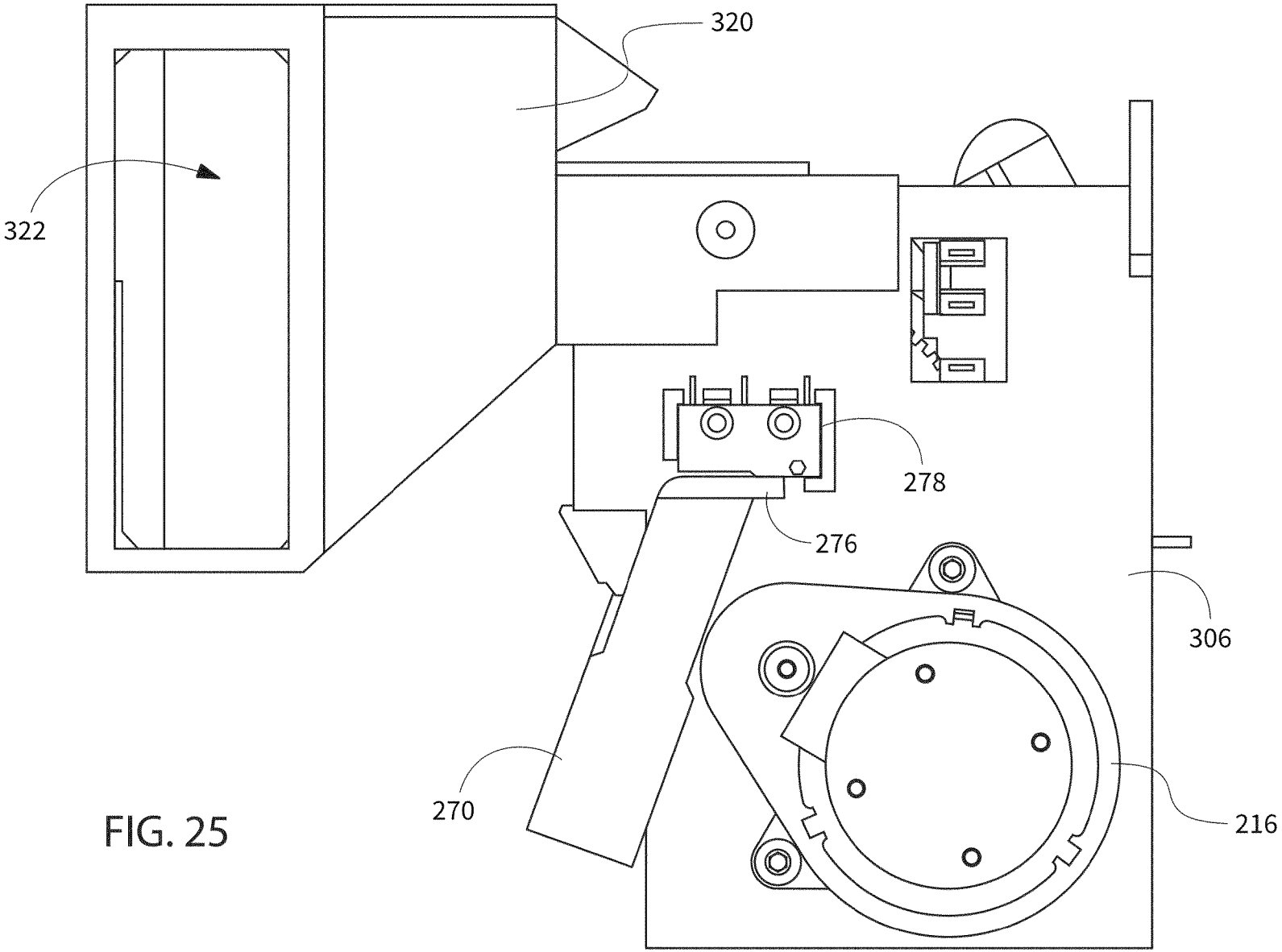
FIG. 25 provides a side view of the exemplary ice making assembly with the feeler arm of the ice making assembly in a first, e.g., down, position.
Figure 26:
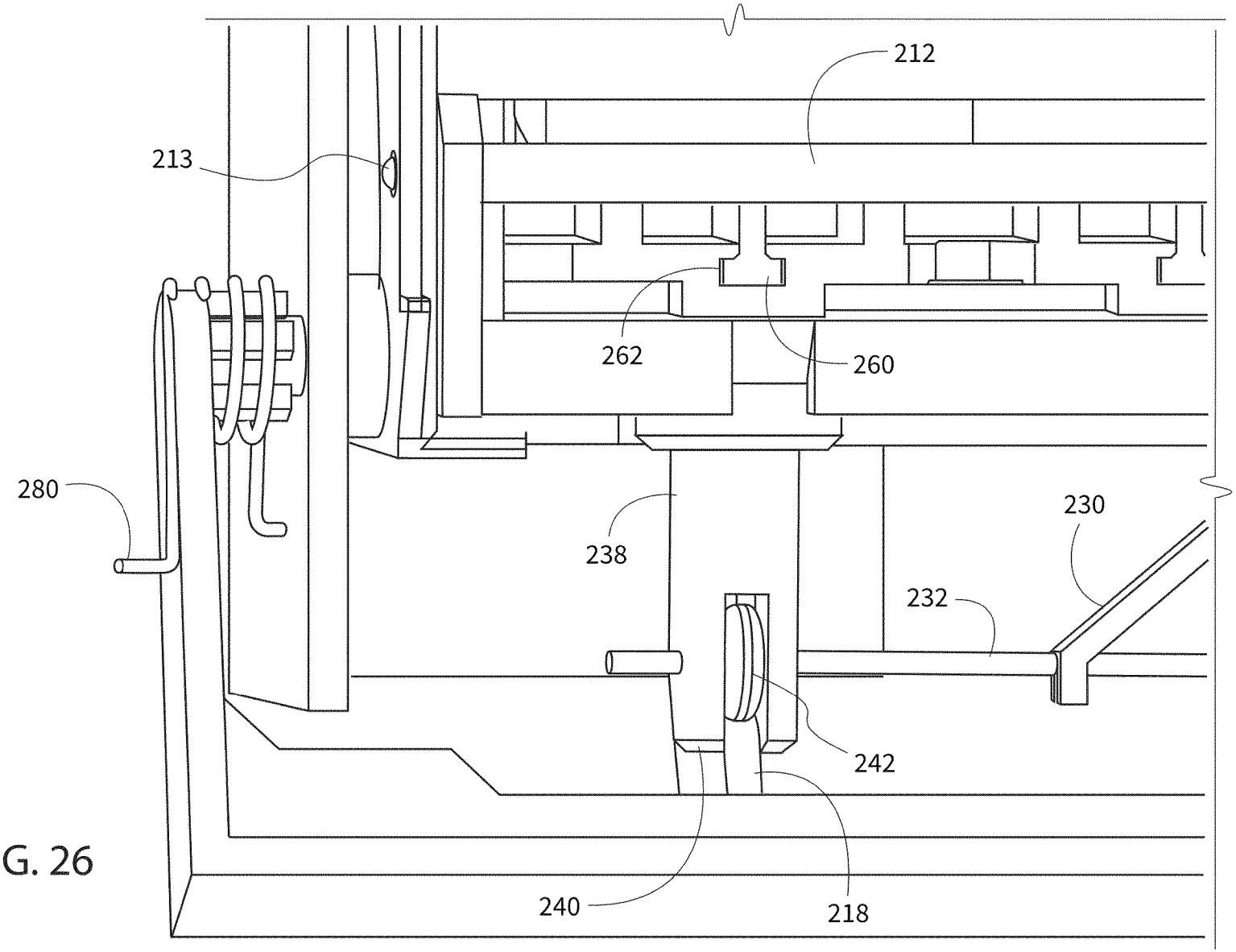
FIG. 26 provides a perspective view of a portion of the exemplary ice making assembly.

Turning now to FIG. 24 and FIG. 25, the feeler arm 270 may include a tab 276 on the feeler arm 270. When the feeler arm 270 travels all the way down to the home position, e.g., after a harvest operation and to the position illustrated in FIG. 25, the tab 276 on the feeler arm 270 may engage (e.g., close) a switch 278. When the switch 278 is closed after the harvest operation, a subsequent cycle of the ice making assembly 200 may be initiated. The ice making assembly 200 may further include a biasing element, e.g., spring 280 (FIG. 26), which is connected to the feeler arm 270 and to one of the left and right brackets 304 and 306. The biasing element 280 may be configured to urge feeler arm 270 downward, such that once the lever 272 (FIG. 23) rides off of the rib 274 on the carriage 206, the feeler arm 270 is urged back to the home (down) position, to close the switch 278, unless the downward travel of the feeler arm 270 is obstructed, e.g., by ice pieces 1000 in a full ice storage bin as mentioned above.

The harvest operation may be initiated in response to one or more sensor readings which indicate the liquid water in the mold 210 has converted to ice, e.g., frozen. As may be seen for example in FIG. 27, the ice making assembly 200 may include a temperature sensor 215, e.g., thermistor, which extends through carriage 206 into a slot 298 in the cartridge 208, such that the temperature sensor 215 is thereby positioned proximate to the mold 210 and cavities 226 thereof, permitting the temperature sensor 215 to measure a temperature indicative of the state of water in the mold 210, e.g., whether the water is liquid or frozen solid. When the temperature measured by the temperature sensor 215 indicates ice pieces 1000 have been formed, the harvest operation, e.g., rotation of the carriage 206 and cartridge 208 therein to the harvest position from the home position as described above, may be initiated, e.g. by the controller 164 in response to a signal from the temperature sensor 215, the signal indicative of the temperature measured by sensor 215 having reached a predetermined threshold temperature for ice formation, such as the measured temperature having been at or below the predetermined threshold temperature for at least a minimum time. In additional embodiments, a non-contact temperature sensor, e.g., an infrared temperature sensor, may be used as well as or instead of the temperature sensor 215.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for an ice maker appliance, comprising:

a carriage, the carriage rotatable between a first position and a second position;

a mold defining a cavity for formation of an ice piece therein, the mold releasably received in the carriage whereby the mold is rotatable with the carriage between the first position and the second position;

an ejector positioned adjacent to the mold and rotatable with the carriage between the first position and the second position, the ejector configured to push the ice piece out of the cavity as the carriage rotates between the first position and the second position;

a motor for rotating the carriage from the first position to the second position; and a cartridge, the cartridge comprising the mold and the ejector, the cartridge releasably received in the carriage whereby the entire cartridge is rotatable with the carriage between the first position and the second position.

2. The ice making assembly of claim 1, wherein the cartridge comprises a latch, wherein the latch releasably engages the carriage while the cartridge is received in the carriage.

3. The ice making assembly of claim 1, further comprising a cam in mechanical communication with the ejector, the cam defining a compound arcuate path that is followed by one end of the ejector as it rotates between the first position and the second position.

4. The ice making assembly of claim 1, wherein the ejector is configured to move between a retracted position and an extended position as the carriage rotates between the first position and the second position.

5. The ice making assembly of claim 1, wherein the carriage comprises a mechanical stop, the mechanical stop positioned and configured to abut a bracket of the ice making assembly when the carriage reaches the second position.

6. The ice making assembly of claim 1, wherein the mold comprises a flexible material, wherein the flexible material of the mold deforms when the ejector pushes the ice piece out of the cavity.

7. The ice making assembly of claim 1, further comprising a feeler arm and a lever attached to the feeler arm, the lever configured to rotate the feeler arm upwards as the carriage rotates from the first position to the second position, the feeler arm positioned and configured to extend into a storage volume of a storage bin positioned below the carriage while the carriage is in the first position, whereby the feeler arm detects a level of ice pieces stored in the storage volume.

8. The ice making assembly of claim 1, further comprising a sweep assembly, the sweep assembly configured to move across the mold when the carriage rotates from the first position to the second position.

9. An ice making assembly for an ice maker appliance, comprising:

a cartridge comprising a mold and an ejector, the mold defining a cavity for formation of an ice piece therein, the ejector positioned adjacent to the mold, the cartridge rotatable between a first position and a second position, the ejector configured to push the ice piece out of the cavity as the cartridge rotates between the first position and the second position;

a motor for rotating the cartridge from the first position to the second position; and a carriage, wherein the cartridge is releasably received in the carriage, wherein the motor is configured for rotating the carriage from the first position to the second position, whereby the cartridge rotates with the carriage between the first position and the second position.

10. The ice making assembly of claim 9, wherein the cartridge comprises a latch, wherein the latch releasably engages the carriage while the cartridge is received in the carriage.

11. The ice making assembly of claim 9, wherein the carriage comprises a mechanical stop, the mechanical stop positioned and configured to abut a frame when the carriage reaches the second position.

12. The ice making assembly of claim 9, further comprising a cam in mechanical communication with the ejector, the cam defining a compound arcuate path that is followed by one end of the ejector as it rotates between the first position and the second position.

13. The ice making assembly of claim 9, wherein the ejector is configured to move between a retracted position and an extended position as the cartridge rotates between the first position and the second position.

14. The ice making assembly of claim 9, wherein the mold comprises a flexible material, wherein the flexible material of the mold deforms when the ejector pushes the ice piece out of the cavity.

15. The ice making assembly of claim 9, further comprising a feeler arm and a lever attached to the feeler arm, the lever configured to rotate the feeler arm upwards as the cartridge rotates from the first position to the second position, the feeler arm positioned and configured to extend into a storage volume of a storage bin positioned below the cartridge while the cartridge is in the first position, whereby the feeler arm detects a level of ice pieces stored in the storage volume.

16. The ice making assembly of claim 9, further comprising a sweep assembly, the sweep assembly configured to move across the mold when the cartridge rotates from the first position to the second position.

* * * * *